US010797438B2

(12) United States Patent
Masunaga et al.

(10) Patent No.: US 10,797,438 B2
(45) Date of Patent: Oct. 6, 2020

(54) ELECTRICAL CONNECTOR AND CONNECTOR DEVICE

(71) Applicant: DAI-ICHI SEIKO CO.,LTD., Kyoto-shi, Kyoto (JP)

(72) Inventors: Takashi Masunaga, Ogori (JP); Hiroharu Ikari, Ogori (JP)

( * ) Notice: Subject to any disclaimer, the term of this patent is extended or adjusted under 35 U.S.C. 154(b) by 0 days.

(21) Appl. No.: 16/430,441

(22) Filed: Jun. 4, 2019

(65) Prior Publication Data

US 2019/0372270 A1 Dec. 5, 2019

(30) Foreign Application Priority Data

Jun. 5, 2018 (JP) ..... 2018-108025

(51) Int. Cl.

| | |
|---|---|
| ***H01R 13/639*** | (2006.01) |
| ***H01R 12/71*** | (2011.01) |
| ***H01R 12/83*** | (2011.01) |
| ***H01R 13/629*** | (2006.01) |
| ***H01R 12/75*** | (2011.01) |
| ***H01R 12/79*** | (2011.01) |
| ***H01R 13/11*** | (2006.01) |
| ***H01R 13/627*** | (2006.01) |

(52) U.S. Cl.

CPC ..... *H01R 13/639* (2013.01); *H01R 12/716* (2013.01); *H01R 12/75* (2013.01); *H01R 12/79* (2013.01); *H01R 12/83* (2013.01); *H01R 13/11* (2013.01); *H01R 13/627* (2013.01); *H01R 13/629* (2013.01)

(58) Field of Classification Search

CPC ..... H01R 12/79; H01R 12/716; H01R 12/83; H01R 12/75; H01R 13/62933; H01R 13/639; H01R 13/629; H01R 13/11; H01R 13/627

USPC ..... 439/329, 372, 358, 341

See application file for complete search history.

(56) References Cited

U.S. PATENT DOCUMENTS

| | | | | |
|---|---|---|---|---|
| 4,995,825 | A | 2/1991 | Korsunsky et al. | |
| 6,666,702 | B1 * | 12/2003 | Pickles | H01R 12/716 439/326 |
| 6,830,478 | B1 * | 12/2004 | Ko | H01R 13/6275 439/579 |
| 7,083,459 | B1 * | 8/2006 | Wu | H01R 13/6275 439/354 |
| 7,841,889 | B2 * | 11/2010 | Gerard | H01R 13/6272 439/358 |

(Continued)

FOREIGN PATENT DOCUMENTS

| | | |
|---|---|---|
| CN | 101242041 | 8/2008 |
| CN | 101789556 | 7/2010 |

(Continued)

*Primary Examiner* — Gary F Paumen

(74) *Attorney, Agent, or Firm* — Soei Patent & Law Firm

(57) ABSTRACT

A connector device includes an electrical connector that connects to a receptacle connector, an electric cable connected to the electrical connector, and a lock member attached to the electrical connector. The lock member has a main body portion to sandwich the electrical connector in a fitted state between the receptacle connector and the main body portion, and a lock engagement portion to engage with a connector engagement portion provided in the receptacle connector. The lock engagement portion has a hanging portion, a folded portion, and an extending portion.

20 Claims, 15 Drawing Sheets

(56) References Cited

U.S. PATENT DOCUMENTS

| | | | | |
|---|---|---|---|---|
| 8,011,936 | B2 * | 9/2011 | Goto | H05K 7/026 439/341 |
| 2005/0181670 | A1 * | 8/2005 | Kumamoto | H01R 13/6275 439/358 |
| 2011/0092091 | A1 * | 4/2011 | Ogura | H01R 12/79 439/345 |
| 2013/0273760 | A1 * | 10/2013 | Narita | H01R 13/629 439/153 |
| 2014/0227899 | A1 * | 8/2014 | Tanaka | H01R 13/631 439/357 |
| 2014/0322958 | A1 * | 10/2014 | Wu | H01R 13/6275 439/372 |
| 2015/0087178 | A1 | 3/2015 | Ozeki | |
| 2015/0155658 | A1 | 6/2015 | Urano et al. | |
| 2015/0171536 | A1 * | 6/2015 | Kameda | H01R 12/772 439/329 |
| 2018/0138606 | A1 * | 5/2018 | Uchida | H01R 12/91 |

FOREIGN PATENT DOCUMENTS

| | | |
|---|---|---|
| CN | 102195198 | 9/2011 |
| CN | 103094781 | 5/2013 |
| CN | 103119795 | 5/2013 |
| CN | 103730768 | 4/2014 |
| CN | 105514708 | 4/2016 |
| CN | 106252928 | 12/2016 |
| JP | 2010-044904 | 2/2010 |
| JP | 2010-146761 | 7/2010 |
| JP | 2010-212191 | 9/2010 |
| JP | 2014-035851 | 2/2014 |
| WO | 2013/145527 | 10/2013 |

* cited by examiner

ELECTRICAL CONNECTOR AND CONNECTOR DEVICE

CROSS-REFERENCE TO RELATED APPLICATIONS

This application claims the benefit of priority from Japanese Patent Application No. 2018-108025, filed on Jun. 5, 2018, the entire contents of which are incorporated herein by reference.

TECHNICAL FIELD

The present disclosure relates to an electrical connector and a connector device.

BACKGROUND

International Publication No. 2013/145527 discloses an electrical connector provided with a connector having a contact to which an electric wire is attached and a receptacle connector having a receptacle contact electrically connected to the contact and mounted on a main surface (connector mounting surface) of a substrate and connecting the substrate and the electric wire. In the electrical connector, the connector is fitted to the receptacle connector along a direction toward the main surface of the substrate from above the receptacle connector. This type of fitting is also referred to as vertical fitting.

SUMMARY

In a vertical fitting-based electrical connector, an external force in a direction away from the main surface of the substrate may be generated in a plug connector due to, for example, displacement (hereinafter, referred to as "bending") of an electric wire attributable to lifting of a part close to the terminal of the electric wire to which the plug connector is attached. In some examples, a fitted state is maintained without the plug connector being separated from the receptacle connector, such that conduction may be maintained between both connectors even when the external force acts. Additionally, operability of the connector may be preserved during removal or the like with the fitted state firmly maintained.

Accordingly, the electrical connector and a connector device may be reliably maintained in a fitted state even when an external force acts.

An example electrical connector disclosed herein may include a connector portion configured to be fitted to an opposing connector along a first direction, a connection body extending in a second direction perpendicular to the first direction being connected to the connector portion, and a lock member attached to the connector portion and configured to maintain a fitted state where the connector portion and the opposing connector are fitted together. The lock member has a main body portion configured to sandwich the connector portion in the fitted state between the opposing connector and the lock member and at least one lock engagement portion configured to be engageable with at least one connector engagement portion provided in the opposing connector. The lock engagement portion has a hanging portion extending toward the opposing connector in a downward direction from a part of the main body portion close to or adjacent an outside in a third direction, the third direction perpendicular to both the first direction and the second direction. In some examples, the downward direction is the first direction. Additionally, the lock engagement portion may have a folded portion extending so as to be folded back inward in the third direction from a lower end of the hanging portion, and an extending portion extending away from the opposing connector in an upward direction from a part of the folded portion close to or adjacent an inside in the third direction. In some examples, the extending portion may include an engagement portion engaging with the connector engagement portion, the upward direction being the first direction.

In some examples, the lock engagement portion of the lock member and the connector engagement portion of the opposing connector can be engaged with each other. As a result, the lock member may be connected to the opposing connector, and thus an upward movement of the connector portion sandwiched between the opposing connector and the lock member is regulated. Accordingly, the fitted state may be maintained even when an external force attributable to bending or the like acts on the connector portion through the connection body. Further, the lock engagement portion has the hanging portion extending downward, the folded portion folded back inward from the lower end of the hanging portion, and the extending portion extending upward from the part close to or adjacent the inside of the folded portion. In some examples, the lock engagement portion is formed in a substantially U-shape. The engagement state of the engagement portion of the lock engagement portion and the connector engagement portion of the opposing connector is released during removal. In some examples, the lock engagement portion is displaced (e.g., bent or deformed) when the engagement state is released. When the lock engagement portion is formed in a U-shape, the spring length of the lock engagement portion (length of the part functioning as a spring) can be increased such that the engagement release (disengagement) operation can be performed with appropriate predetermined force under limited connector height conditions. Accordingly, the fitted state may be reliably maintained even when the external force acts and the operability may be preserved during the removal process and the like.

In some examples, a slit may be formed in the lock engagement portion to facilitate bending or displacement of the lock engagement portion and to preserve operability during the removal process and the like.

The lock engagement portion may be disposed close to or adjacent a rear of the connector portion in a case where a direction in which the connection body extends toward the connector portion is forward in the second direction and a direction in which the connection body extends away from the connector portion is rearward in the second direction. An external force in a direction away from the opposing connector (external force attributable to bending) may be applied to the part of the connector portion close to or adjacent the rear to which the connection body is attached in a case where the connection body is displaced by the part of the connection body close to or adjacent the connector portion being lifted (in the case of so-called bending reception). For examples, the lock engagement portion may be disposed close to or adjacent the rear of the connector portion, and thus the fitted state can be reliably maintained even in a case where the external force attributable to bending acts.

The lock member may further have at least one release operation portion connected to the lock engagement portion and configured such that operation for releasing the engagement between the connector engagement portion and the lock engagement portion is performed. The engagement between the connector engagement portion and the lock engagement portion can be released by the release operation portion to facilitate operability during the removal process.

The release operation portion may be disposed close to or adjacent the rear of the connector portion. The connection body extends behind the connector portion. As a result of the disposition of the release operation portion at the position close to or adjacent the rear where another member (connection body) is provided, the space on a wiring substrate on which the opposing connector is mounted can be effectively used.

The release operation portion may release the engagement between the connector engagement portion and the lock engagement portion by being operated or displaced upward. In some examples in which engagement between the connector engagement portion and the lock engagement portion is released by the release operation portion being pressed, the pressing may cause a high load to be applied to a solder portion of the wiring substrate on which the opposing connector is mounted by solder or the like. The configuration in which the release operation portion is operated upward is adopted in this regard, and thus the engagement may be released while reducing the load on the wiring substrate to avoid a connection failure.

The lock member may be attached to the connector portion so as to be pivotable about a pivot shaft extending along the third direction. The lock is readily released or disengaged by the lock member pivoting around the pivot shaft, and thus the removal work can be further facilitated. In addition, dissipation of parts can be suppressed since the lock member is attached to the connector portion via the pivot shaft.

The pivot shaft of the lock member may be disposed close to or adjacent a front of the connector portion. As a result, a predetermined distance can be maintained between the pivot shaft disposed close to or adjacent the front and the release operation portion disposed close to or adjacent the rear to facilitate releasing the lock by pivoting the lock member about the pivot shaft.

The lock engagement portion may be disposed between the pivot shaft and the release operation portion in the second direction. As a result, the release operation portion, the lock engagement portion, and the pivot shaft may be sequentially disposed from the rear toward the front. During the lock release, the lock member is pivoted after the engagement of the connector engagement portion and the lock engagement portion is released by the release operation portion being operated. The above-described example disposition may result in a sequential operation from the configuration disposed in the rear toward the configuration disposed in the front to facilitate operability of the connector.

A main surface of the release operation portion may be disposed so as to be substantially flush with a main surface of the main body portion. To facilitate operating (lifting) the release operation portion, the release operation portion may not be disposed at an extremely low part of the main body portion. In a case where the release operation portion is disposed above the main body portion, the height of the connector may be increased. The main surface of the release operation portion may be disposed so as to be substantially flush with the main surface of the main body portion in this regard to avoid an increase in the height of the connector, and to facilitate the operability of the connector.

In some examples, a connector device may include a first connector, a second connector configured to be fitted to the first connector along a first direction, a connection body extending in a second direction perpendicular to the first direction being connected to the second connector, and a lock member attached to the second connector and configured to maintain a fitted state where the second connector and the first connector are fitted together. The first connector has at least one connector engagement portion. The lock member has a main body portion configured to sandwich the second connector in the fitted state between the first connector and the lock member and at least one lock engagement portion configured to be engageable with the at least one connector engagement portion. The lock engagement portion has a hanging portion extending toward the first connector in a downward direction from a part of the main body portion close to or adjacent an outside in a third direction. In some examples, the third direction is perpendicular to both the first direction and the second direction, and the downward direction is the first direction. Additionally, the lock engagement portion may have a folded portion extending so as to be folded back inward in the third direction from a lower end of the hanging portion, and an extending portion extending away from the first connector in an upward direction from a part of the folded portion close to or adjacent an inside in the third direction. In some examples, the extending portion may include an engagement portion engaging with the connector engagement portion, the upward direction being the first direction.

The first connector may further have a protective portion positioned outside the hanging portion in the third direction in the state where the second connector and the first connector are fitted together. In a case where the lock engagement portion is deformed outward in the third direction, for example, engagement between the lock engagement portion and the connector engagement portion may not be sufficiently performed. The protective portion may be provided outside the lock engagement portion (for example, outside the hanging portion positioned on the outermost side in the lock engagement portion) to prevent an outward deformation of the lock engagement portion. In addition, even in a case where the lock engagement portion is deformed, the protective portion may be configured to hit the lock engagement portion and to correct or adjust a position of the lock engagement portion inward in the third direction during the fitting. Accordingly, engagement between the lock engagement portion and the connector engagement portion can be facilitated.

The protective portion may be provided at a position where the lock engagement portion is sandwiched between the connector engagement portion and the protective portion. As a result, during the fitting, the protective portion is disposed outside the place of engagement between the lock engagement portion and the connector engagement portion to prevent an outward deformation of the lock engagement portion, and to facilitate the inward correction of the lock engagement portion.

The protective portion may be a part of a conductive shell covering an outer surface of the first connector, at least in part. As a result, the protective portion can be provided without an increase in the number of parts.

Example electrical connectors and connector devices are therefore disclosed herein for reliably maintaining a fitted state even when an external force acts.

BRIEF DESCRIPTION OF THE DRAWINGS

FIG. 14 is a diagram illustrating the connector device (fitted state) in FIG. 12, in which

DETAILED DESCRIPTION

In the following description, with reference to the drawings, the same reference numbers are assigned to the same components or to similar components having the same function, and overlapping description is omitted. With respect to the drawings, the positive Z-axis direction will be referred to as "upward direction" and the negative Z-axis direction will be referred to as "downward direction" in some cases. Further, with respect to the drawings, the positive X-axis direction will be referred to as "rearward direction" and the negative X-axis direction will be referred to as "forward direction" in some cases. It is to be understood that not all aspects, advantages and features described herein may necessarily be achieved by, or included in, any one particular example. Indeed, having described and illustrated various examples herein, it should be apparent that other examples may be modified in arrangement and detail.

Connector Device

Figure 1:
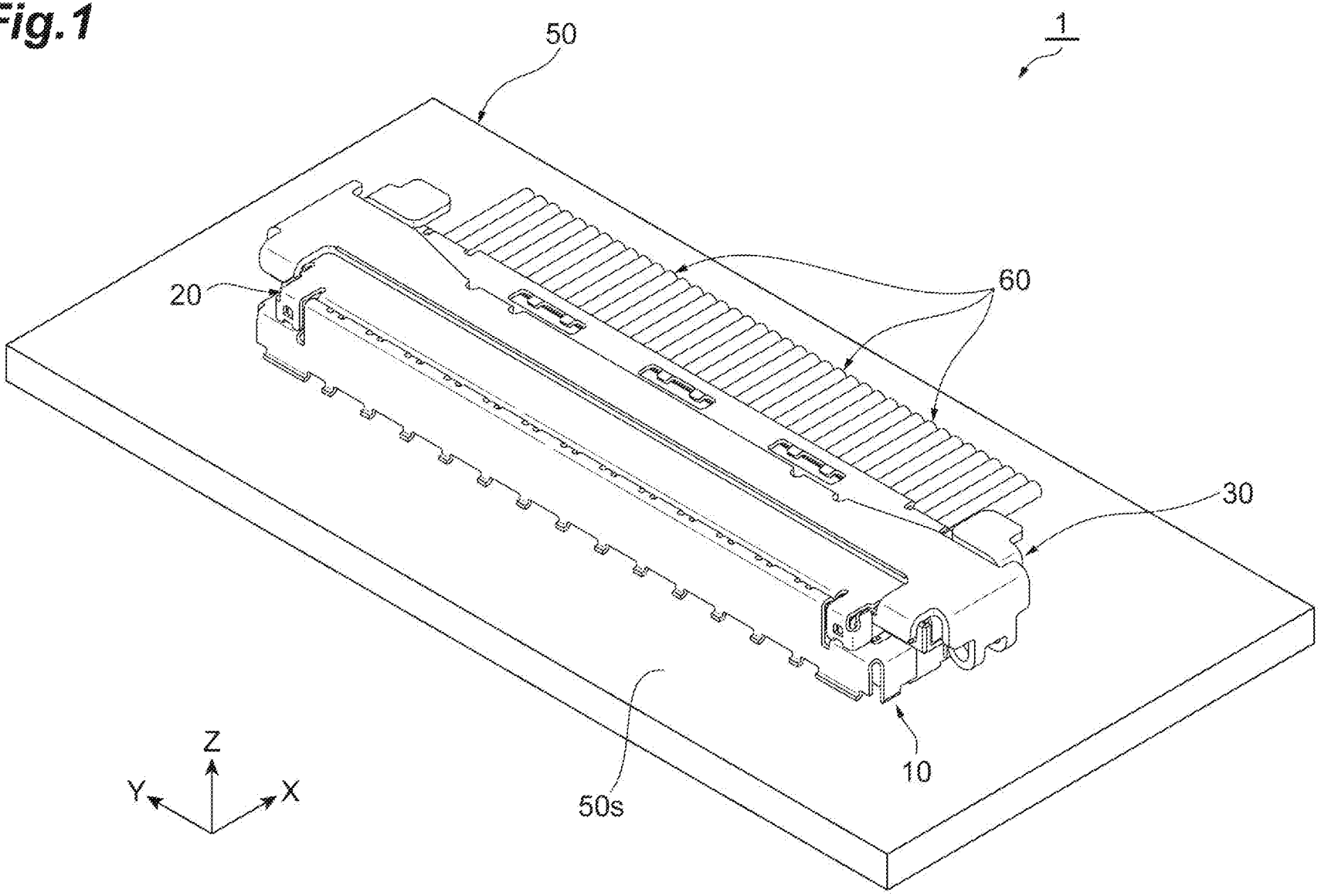
FIG. 1 is a perspective view illustrating an example connector device.
Figure 2:
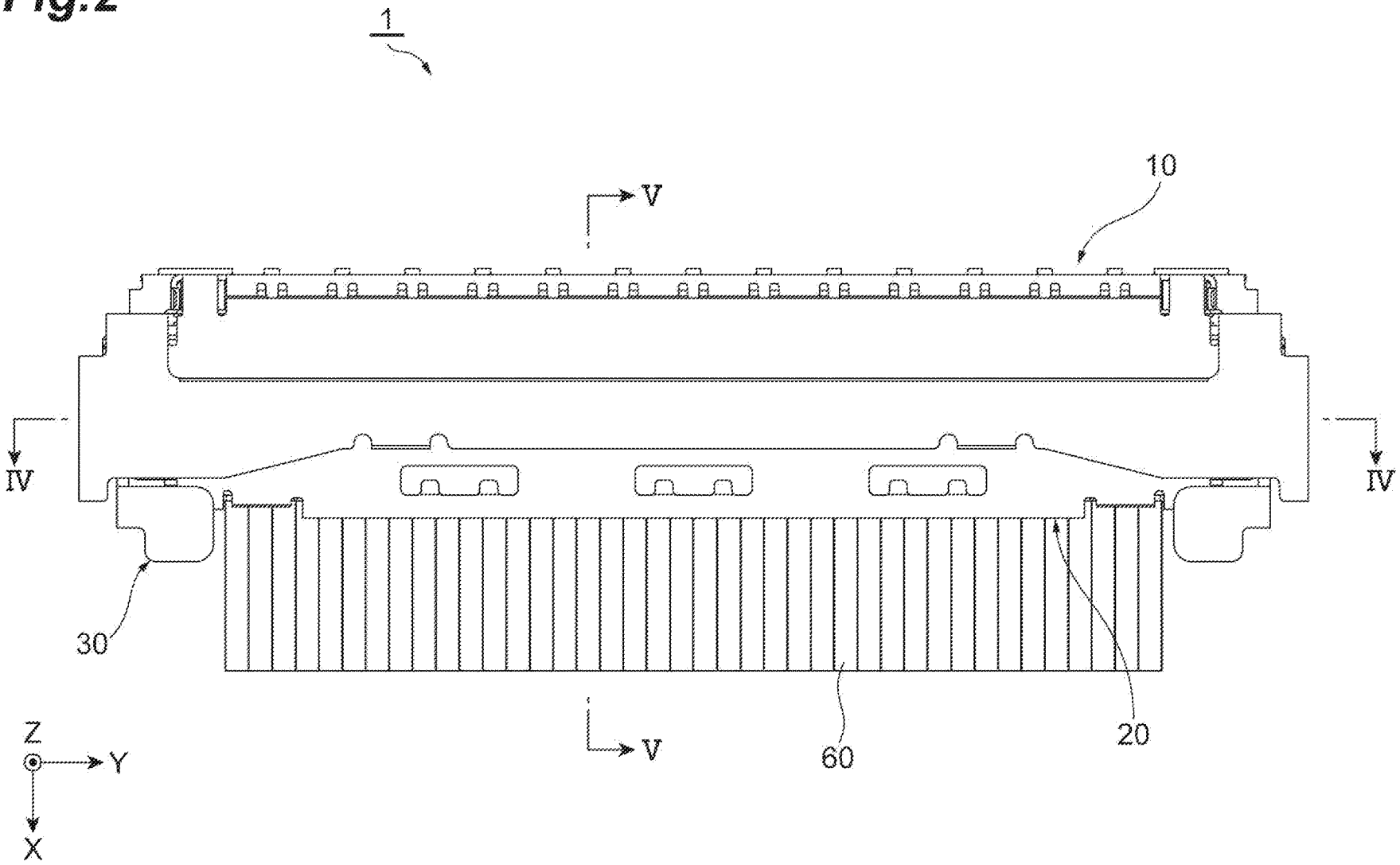
FIG. 2 is a plan view illustrating the connector device in FIG. 1.
Figure 3:
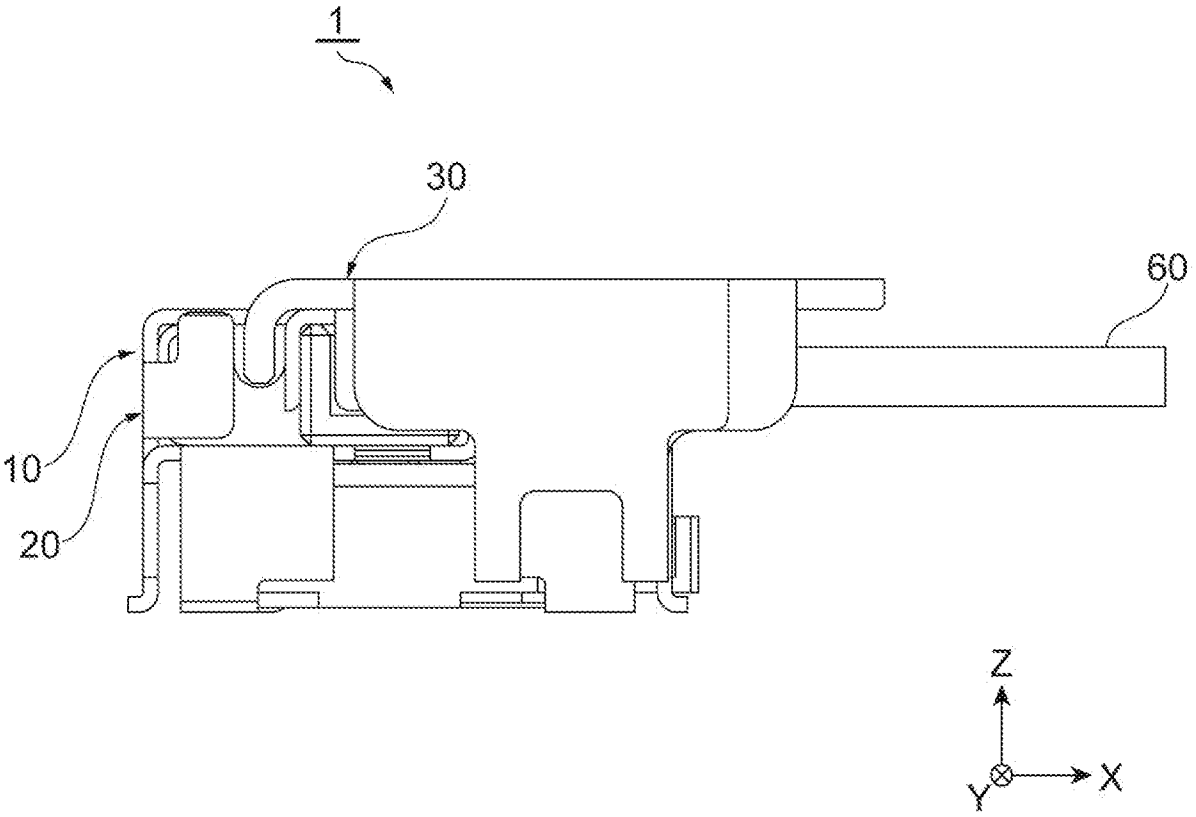
FIG. 3 is a side view illustrating the connector device in FIG. 1.

An example connector device 1 is described with reference to FIGS. 1 to 3. As illustrated in FIGS. 1 to 3, the connector device 1 is provided with a receptacle connector 10 (opposing connector), a plug connector 20 (connector portion), and a lock member 30. The receptacle connector 10 is attached to a circuit board 50 and is electrically connected to the circuit board 50. The plug connector 20 is attached to an electric cable 60 (connection body) and is electrically connected to the electric cable 60.

The receptacle connector 10 and the plug connector 20 are configured such that the receptacle connector 10 and the plug connector 20 can be fitted together and removed from each other along a first direction (such as the Z-axis direction) perpendicular to a main surface 50*s* (such as the XY plane) of the circuit board 50. The lock member 30 is configured to maintain a fitted state where the receptacle connector 10 and the plug connector 20 are fitted together. In the fitted state of the receptacle connector 10 and the plug connector 20, a conductive path (such as wiring) formed on the main surface 50*s* of the circuit board 50 and the electric cable 60 is electrically connected. In some examples, the connector device 1 is a device for electrically and physically connecting the conductive path and an electric cable.

The circuit board 50 is an example substrate on which electronic circuits and electronic components may be mounted. The circuit board 50 may comprise, for example, a printed wiring board or a flexible printed board. The receptacle connector 10 may be mounted on the main surface 50*s* of the circuit board 50 by solder connection or the like.

The electric cable 60 is wiring used for a signal or the like to be transmitted between various circuit boards incorporated in a small electronic device such as a mobile phone. In the fitted state of the receptacle connector 10 and the plug connector 20, the electric cable 60 extends along a second direction (such as the X-axis direction) perpendicular to the first direction. The electric cable 60 includes an internal conductor 61, an insulator 62, an external conductor 63, and a protective coating 64 (see FIG. 5). A linearly extending metal wire (such as a copper wire) constitutes the internal conductor 61. The insulator 62 covers the circumferential surface of the internal conductor 61. A cylindrical metal braided wire constitutes the external conductor 63, and the external conductor 63 covers the circumferential surface of the insulator 62. The protective coating 64 covers the circumferential surface of the external conductor 63.

In the electric cable 60, the internal conductor 61, the insulator 62, the external conductor 63, and the protective coating 64 may be sequentially exposed in steps in this order from the distal end portion (terminal part) to which the plug connector 20 is attached toward the proximal end portion (terminal part opposite to the distal end portion). The electric cable 60 is a coaxial cable or the like. The plug connector 20 may be a connector for a coaxial cable extending along a third direction (such as the Y-axis direction) perpendicular to both the first direction and the second direction.

In some examples, the first direction is along the Z-axis direction, the second direction is along the X-axis direction, and the third direction is along the Y-axis direction.

Receptacle Connector

Figure 4:
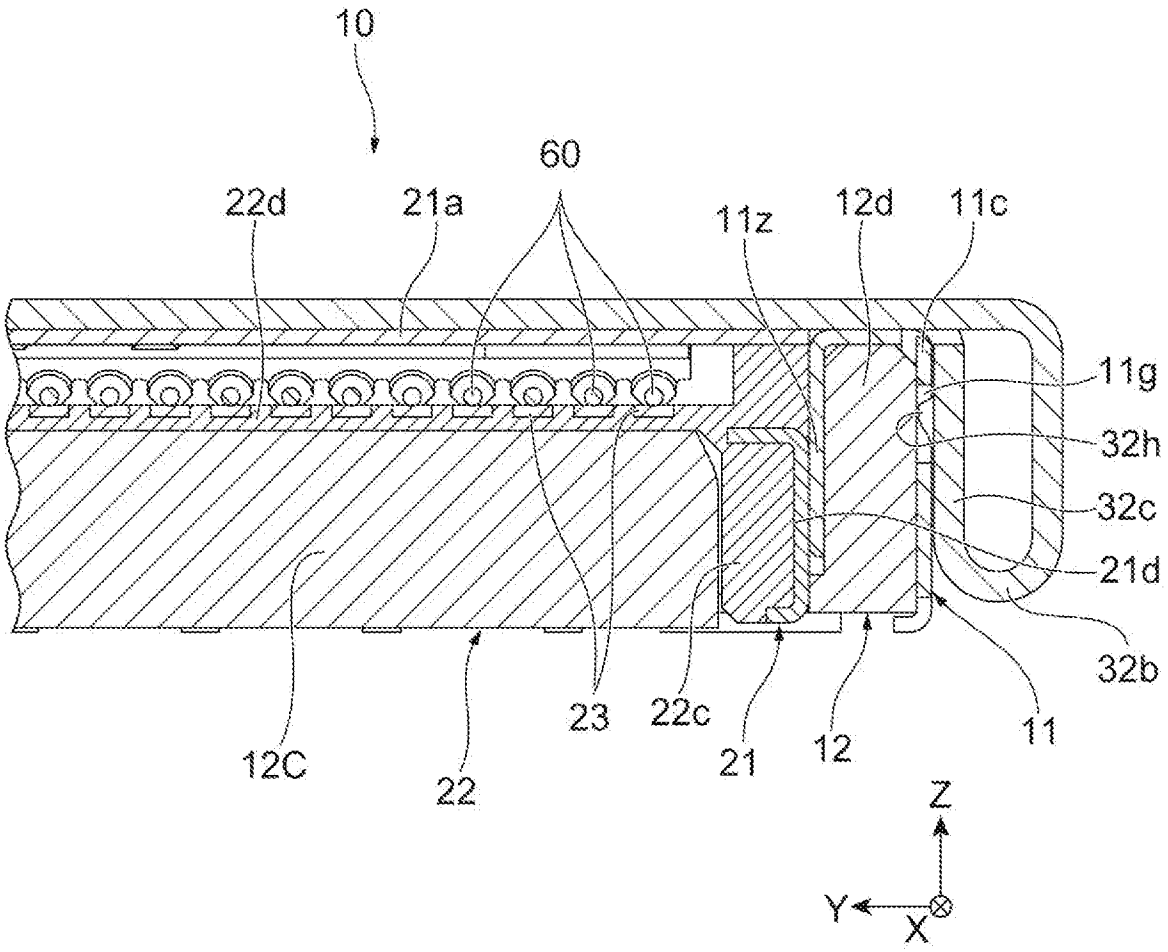
FIG. 4 is a cross-sectional view taken along line IV-IV in FIG. 2.
Figure 5:
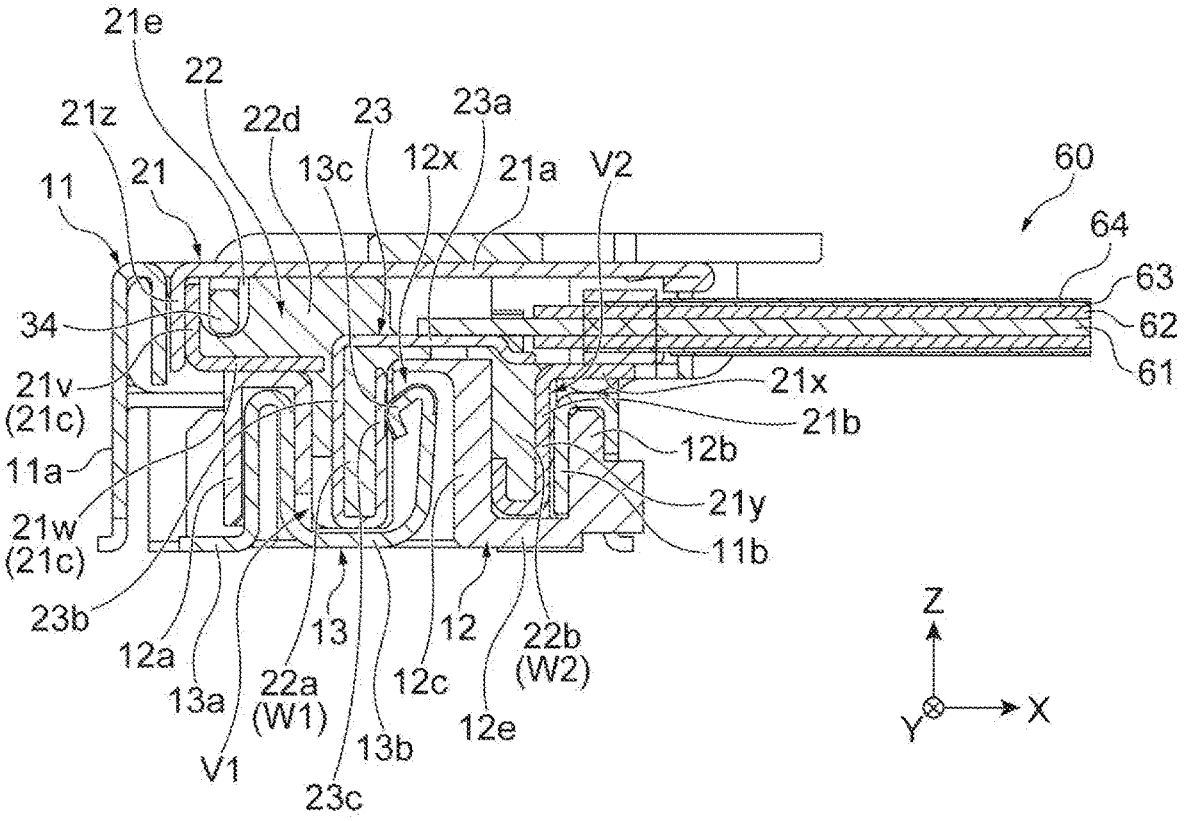
FIG. 5 is a cross-sectional view taken along line V-V in FIG. 2.
Figure 6A:
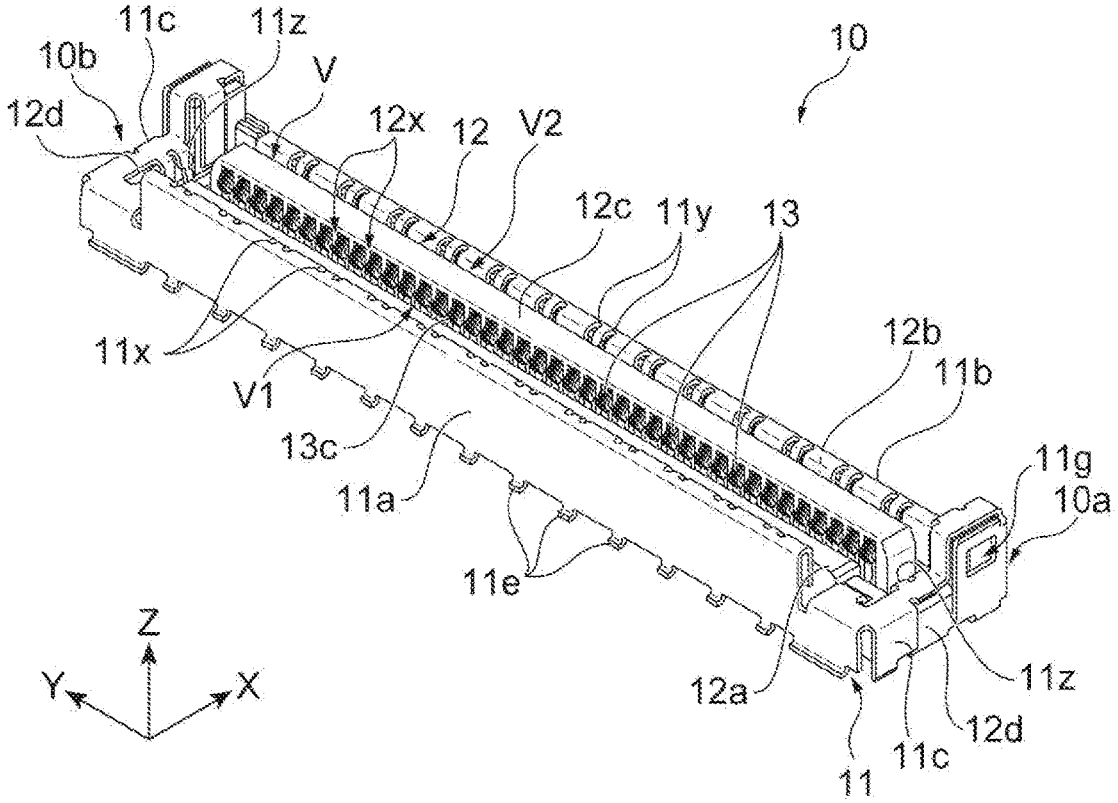
FIGS. 6A and 6B are perspective views illustrating an example receptacle connector included in the connector device in FIG. 1.
Figure 6B:
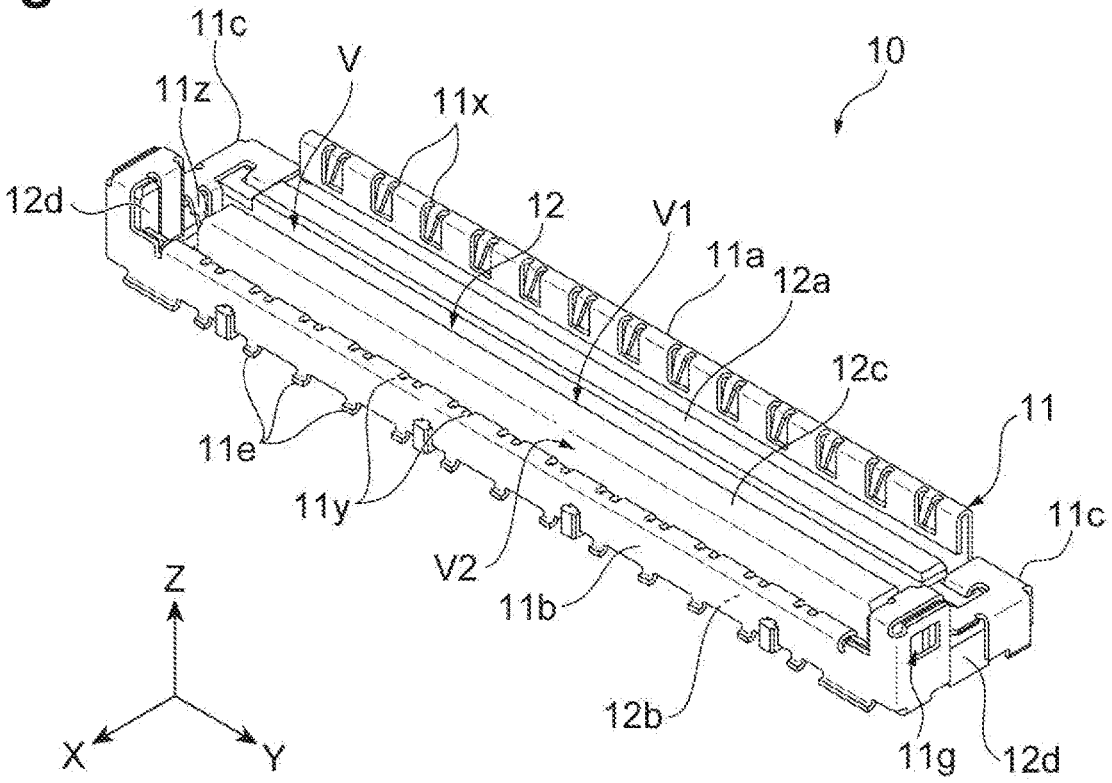

The receptacle connector 10 is described in additional detail with reference to FIGS. 4 to 6A and 6B. The receptacle connector 10 is a long connector extending along the Y-axis direction as a whole and is attached to the main surface 50*s* of the circuit board 50 (see FIG. 1). Accordingly, as illustrated in FIGS. 6A and 6B, one end portion 10*a* and the other end portion 10*b* of the receptacle connector 10 face each other in the Y-axis direction. As illustrated in FIGS. 6A and 6B, the receptacle connector 10 includes a shell 11, a housing 12, and a plurality of conductive terminals 13.

A resin-containing insulating material constitutes the housing 12. The housing 12 holds the plurality of conductive terminals 13 and provides insulation between the shell 11 and the conductive terminal 13. As illustrated in FIGS. 4 to 6A and 6B, the housing 12 includes, for example, side walls 12*a* and 12*b*, a middle wall 12*c*, two side walls 12*d* and 12*d*, and a bottom wall 12*e*. The bottom wall 12*e* is a plate-shaped body having a substantially rectangular shape. Each of the side walls 12*a* and 12*b*, the middle wall 12*c*, and the side walls 12*d* and 12*d* is provided on the bottom wall 12*e* so as to stand from the bottom wall 12*e*.

The side walls 12*a* and 12*b* are respectively positioned near the long sides of the bottom wall 12*e* and extend in the Y-axis direction along the long sides. Accordingly, the side walls 12*a* and 12*b* face each other in the X-axis direction. The side wall 12*a* is provided such that a part of the conductive terminal 13 is accommodated in the side wall 12*a* (e.g., so as to surround a part of the conductive terminal 13). The outer and inner surfaces of the side wall 12*b* in the X-axis direction are covered by a side wall 11*b* (described in additional detail later) of the shell 11. The side walls 12*d* and 12*d* are respectively positioned near the short sides of the bottom wall 12*e* and extend in the X-axis direction along the short sides. Accordingly, the side walls 12*d* and 12*d* face each other in the Y-axis direction. The outer and inner surfaces of the side walls 12*d* and 12*d* in the Y-axis direction are covered by a side wall 11*c* (described in additional detail later) of the shell 11.

The middle wall 12*c* is positioned in the space that is surrounded by the side walls 12*a*, 12*b*, 12*d*, and 12*d* in a state where the middle wall 12*c* is apart from the side walls 12*a*, 12*b*, 12*d*, and 12*d*. The middle wall 12*c* extends along the side walls 12*a* and 12*b* between the side walls 12*a* and 12*b* (in the Y-axis direction, which is the direction of extension of the side walls 12*a* and 12*b*). Accordingly, the middle wall 12*c* faces the side walls 12*a* and 12*b* in the X-axis direction. A plurality of notches 12*x* for exposing the conductive terminal 13 are formed in the surface of the middle wall 12*c* that faces the side wall 12*a*.

The housing 12 has a concave recess V having a square ring shape by being configured to include the side walls 12*a* and 12*b*, the middle wall 12*c*, the side walls 12*d* and 12*d*, and the bottom wall 12*e*. The recess V is a space accommodating the plug connector 20 and has a pair of recesses V1 and V2. The first recess V1 is formed by the space that is surrounded by the side wall 12*a*, the middle wall 12*c*, and the bottom wall 12*e* and accommodates a protrusion W1 (see FIG. 7B) of the plug connector 20. The second recess V2 is formed by the space that is surrounded by the side wall 12*b*, the middle wall 12*c*, and the bottom wall 12*e* and accommodates a protrusion W2 (see FIG. 7B) of the plug connector 20.

A pressed metallic and plate-shaped member or the like constitutes the shell 11. The shell 11 has elasticity and conductivity. As illustrated in FIGS. 6A and 6B, the shell 11 includes, for example, a side wall 11*a*, the side walls 11*b* and 11*c*, a plurality of projections 11*e*, and two connector engagement portions 11*g* and 11*g*.

The side walls 11*a* and 11*b* face each other in the X-axis direction and extend along the Y-axis direction as illustrated in FIGS. 5, 6A, and 6B. The side wall 11*a* is positioned outside the side wall 12*a* of the housing 12 in the X-axis direction. The side wall 11*a* extends upward from the main surface 50*s* of the circuit board 50, curves toward the side wall 11*b* at the upper end of the side wall 11*a* (that is, is folded back inward in the X-axis direction), and is configured to be elastically deformable in the X-axis direction. A plurality of slits 11*x* are formed at the folded part of the side wall 11*a* (inner part in the X-axis direction). As a result, the side wall 11*a* is easily bent in the X-axis direction. The side wall 11*b* is provided so as to cover the outer and inner surfaces of the side wall 12*b* of the housing 12 in the X-axis direction. The side wall 11*b* extends upward along the outer surface of the side wall 12*b* from the main surface 50*s* of the circuit board 50, curves toward the side wall 11*a* at the upper end of the side wall 11*b* (that is, is folded back inward in the X-axis direction and extends downward along the inner surface of the side wall 12*b*), and is configured to be elastically deformable in the X-axis direction. A plurality of slits 11*y* are formed at the folded part of the side wall 11*b* (inner part in the X-axis direction). As a result, the side wall 11*b* is readily bent or displaced in the X-axis direction. The height of the side wall 11*b* (length in the Z-axis direction) is approximately half of the height of the side wall 11*a*.

As illustrated in FIGS. 6A and 6B, two side walls 11*c* and 11*c* face each other in the Y-axis direction and extend along the X-axis direction. At least one of the side walls 11*c* is provided so as to cover the outer and inner surfaces of the side wall 12*d* of the housing 12 in the Y-axis direction. The side walls 11*c* and 11*c* are connected to the side walls 11*a* and 11*b*. At least one of the side walls 11*c* has a ground contact portion 11*z* in the middle portion of the side wall 11*c* in the X-axis direction. The ground contact portion 11*z* is a part curving from the upper end of the side wall 11*c* toward the facing side wall 11*c* (recess V direction) and is configured to be elastically deformable in the Y-axis direction. The ground contact portion 11*z* may have a notch for facilitating bending.

As illustrated in FIGS. 5, 6A, and 6B, the plurality of projections 11*e* are provided so as to protrude outward (to the side opposite to the recess V) at the lower ends of the side walls 11*a* and 11*b* and are arranged along the Y-axis direction. Further, the projections 11*e* may be provided so as to protrude outward (to the side opposite to the recess. V) at the lower ends of the side walls 11*c* and 11*c*. The surface of the projection 11*e* that is laid on the main surface 50*s* of the circuit board 50 is electrically connected to the conductive path of the circuit board 50 by solder or the like. In some examples, the projection 11*e* includes an attachment surface configured to be attached to the main surface 50*s* of the circuit board 50.

The connector engagement portions 11*g* and 11*g* are configured to be engageable with a lock engagement portion 32 (described in additional detail later) of the lock member 30. The connector engagement portions 11*g* and 11*g* are disposed in the end portions 10*a* and 10*b*, respectively. As illustrated in FIGS. 4, 6A, and 6B, the connector engagement portions 11*g* and 11*g* are recesses formed in the side walls 11*c* and 11*c*. The connector engagement portions 11*g* and 11*g* are disposed close to or adjacent the rears of the side walls 11*c* and 11*c*. In addition to recesses, the shapes of the connector engagement portions 11*g* and 11*g* may be, for example, notches provided in the side walls 11*c* and 11*c*.

A pressed metallic and plate-shaped member or the like constitutes the plurality of conductive terminals 13. The plurality of conductive terminals 13 have elasticity and conductivity. As illustrated in FIG. 6A, the plurality of conductive terminals 13 are arranged along the Y-axis direction. As illustrated in FIG. 5, each conductive terminal 13 extends along the X-axis direction and includes a proximal end portion 13*a*, an intermediate portion 13*b*, and a contact portion 13*c*.

The proximal end portion 13*a* is disposed on the main surface 50*s* of the circuit board 50 and is connected to the conductive path of the circuit board 50 by solder or the like. The proximal end portion 13*a* is positioned below the side wall 12*a* of the housing 12.

The intermediate portion 13*b* connects the proximal end portion 13*a* and the contact portion 13*c*. The intermediate portion 13*b* is bent in a U-shape in the side wall 12*a* of the housing 12 and then extends to the vicinity of the middle wall 12*c* along the main surface 50*s* of the circuit board 50.

As illustrated in FIG. 5, the contact portion 13*c* is in contact with a conductive terminal 23 (described in additional detail later) of the plug connector 20 in the fitted state of the receptacle connector 10 and the plug connector 20. The contact portion 13*c* extends upward along the middle wall 12*c* and curves at the distal end part of the contact portion 13*c* such that a part of the contact portion 13*c* is exposed between the contact portion 13*c* and the side wall 12*a* in the recess V (exposed from the notch 12*x* of the middle wall 12*c*). As a result, the contact portion 13*c* is configured to be elastically deformable in the X-axis direction.

Figure 7A:
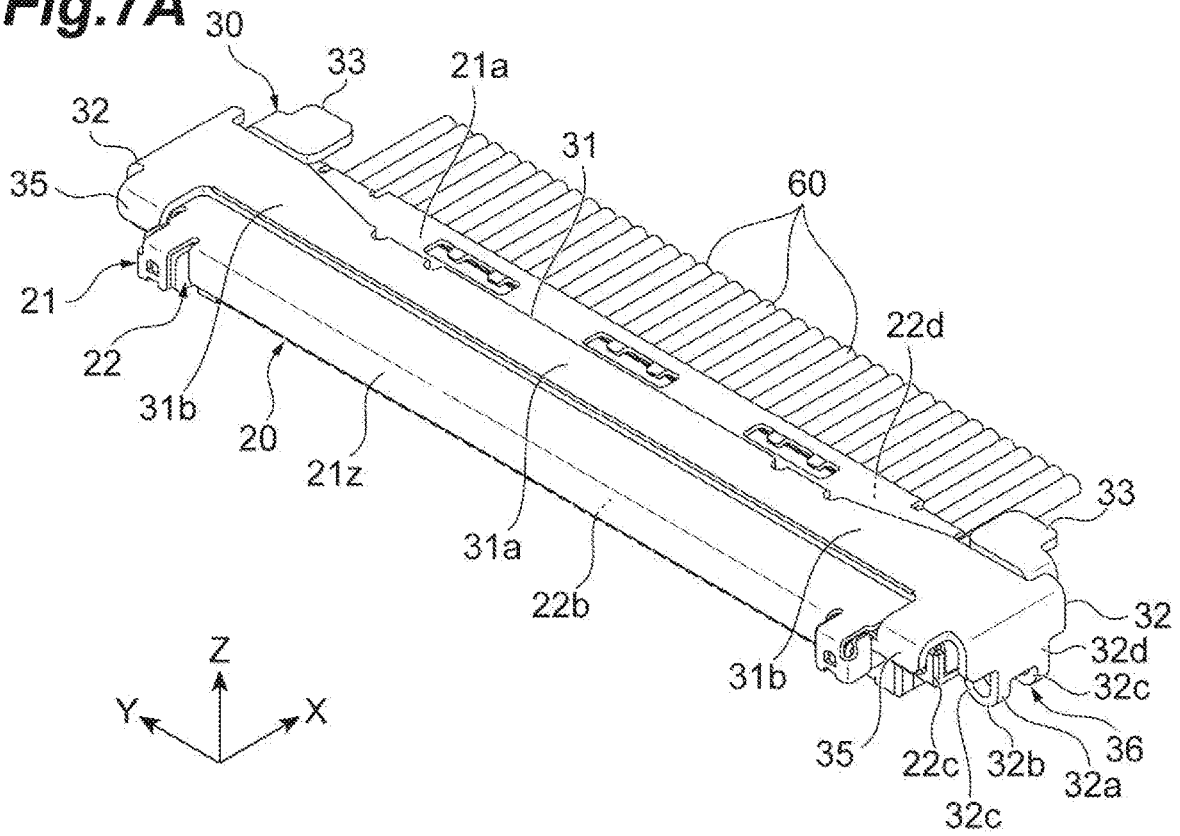
FIGS. 7A and 7B are perspective views illustrating an example plug connector and an example lock member included in the connector device in FIG. 1.
Figure 7B:
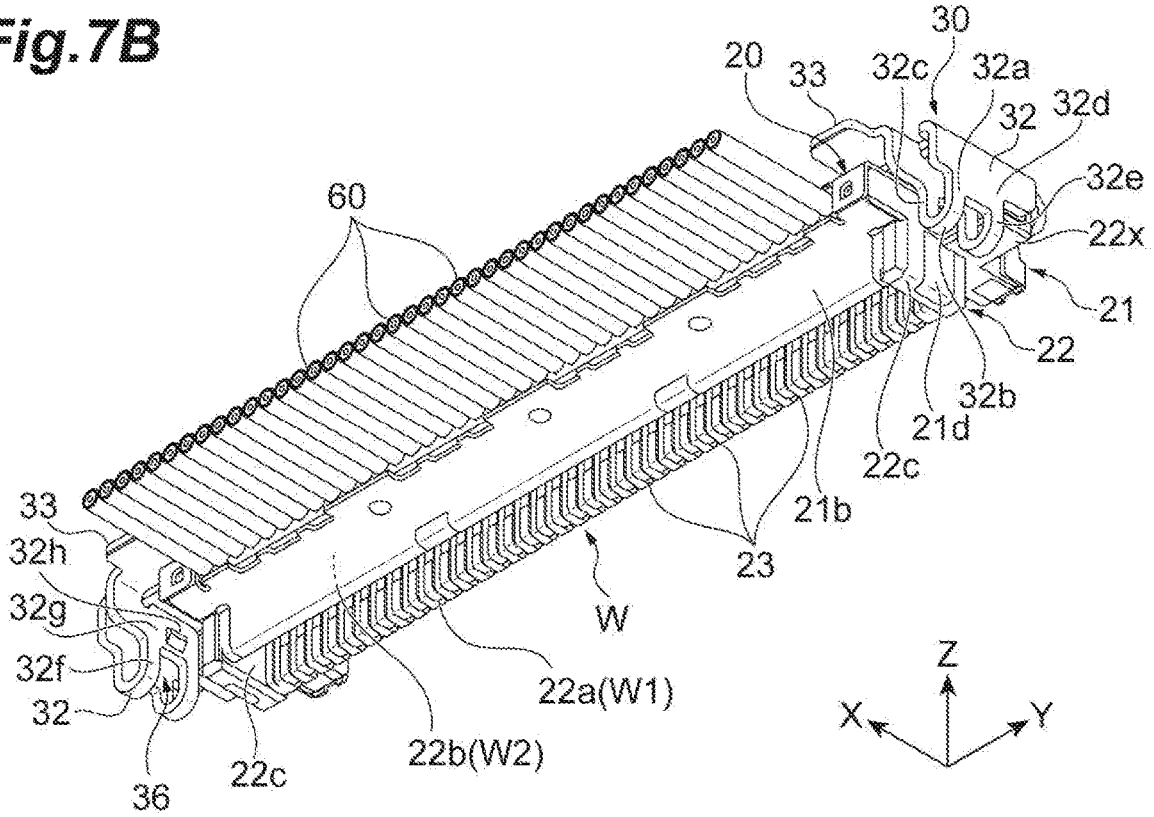

Plug Connector Next, the plug connector 20 is described in further detail with reference to FIGS. 4, 5, 7A, and 7B. The plug connector 20 is a connector configured to be fitted to the receptacle connector 10 (opposing connector) along the Y-axis direction. The electric cable 60 is connected to the plug connector 20. As illustrated in FIGS. 7A and 7B, the plug connector 20 includes a shell 21, a housing 22, and a plurality of the conductive terminals 23.

A resin-containing insulating material constitutes the housing 22. The housing 22 holds the plurality of conductive terminals 23 and provides insulation between the shell 21 and the conductive terminal 23. As illustrated in FIGS. 5, 7A, and 7B, the housing 22 includes, for example, side walls 22*a* and 22*b*, side walls 22*c* and 22*c*, and an upper wall 22*d*. The upper wall 22*d* (see FIG. 5) is a plate-shaped body having a substantially rectangular shape. The upper surface of the upper wall 22*d* is covered by an upper wall 21*a* (described in additional detail later) of the shell 21. Each of the side walls 22*a* and 22*b* and the side walls 22*c* and 22*c* is provided so as to hang down from the upper wall 22*d*.

The side walls 22*a* and 22*b* are respectively positioned near the long sides of the upper wall 22*d* and extend in the Y-axis direction along the long sides. Accordingly, the side walls 22*a* and 22*b* face each other in the X-axis direction. The side wall 22*a* is provided with the conductive terminal 23 as illustrated in FIG. 5. The outer and inner surfaces of the side wall 22*a* in the X-axis direction are covered in part by the conductive terminal 23. The inner and outer surfaces of the side wall 22*b* in the X-axis direction are covered by a side wall 21*b* (described in additional detail later) of the shell 21. The side walls 22*c* and 22*c* are respectively positioned near the short sides of the upper wall 22*d* and extend in the X-axis direction along the short sides. Accordingly, the side walls 22*c* and 22*c* face each other in the Y-axis direction. An overhang 22*x* overhanging further outward in the Y-axis direction from the side walls 22*c* and 22*c* is provided at the upper end parts of the side walls 22*c* and 22*c* (see FIG. 7B). As illustrated in FIG. 7B, the overhang 22*x* functions as the part at which the lock member 30 is placed in a state where the lock member 30 is attached to the plug connector 20.

The side walls 22*a*, 22*b*, 22*c*, and 22*c* are accommodated in the recess V of the receptacle connector 10 when the plug connector 20 and the receptacle connector 10 are fitted together. Accordingly, the side walls 22*a*, 22*b*, 22*c*, and 22*c* constitute a protrusion W having a protruding shape as a whole. The side walls 22*a* and 22*b* constitute the pair of protrusions W1 and W2 and are accommodated in the pair of recesses V1 and V2. In some examples, the side wall 22*a* constituting the protrusion W1 is accommodated in the recess V1 and the side wall 22*b* constituting the protrusion W2 is accommodated in the recess V2 (see FIG. 5). As illustrated in FIG. 5, in the state where the plug connector 20 and the receptacle connector 10 are fitted together, the conductive terminal 23 provided on the side wall 22*a* (protrusion W1) and the conductive terminal 13 exposed from the notch 12*x* of the middle wall 12*c* constituting the recess V2 are in contact with each other and constitute, for example, a part of a signal circuit.

A pressed metallic and plate-shaped member or the like constitutes the shell 21. The shell 21 has elasticity and conductivity. As illustrated in FIGS. 4, 5, 7A, and 7B, the shell 21 includes, for example, the upper wall 21*a*, the side wall 21*b*, a front portion 21*c* (see FIG. 5), a ground contact portion 21*d*, and a bearing 21*e* (see FIG. 5).

The upper wall 21*a* covers the distal end portion of the electric cable 60 and covers the upper surface of the upper wall 22*d* of the housing 22 as illustrated in FIG. 5. The upper wall 21*a* extends in the Y-axis direction as illustrated in FIGS. 4 and 7A. The upper wall 21*a* has a front end portion 21*z* curving at the front end of the upper wall 21*a* in the X-axis direction and extending downward as illustrated in FIGS. 5 and 7A. In addition, the upper wall 21*a* has a part covering the upper surface of the overhang 22*x* (see FIG. 7B) and the outer surface (side surface) of the overhang 22*x* in the Y-axis direction. The upper wall 21*a* of the shell 21 is attached to the housing 22 after the lock member 30 is completely placed (attached) for the plug connector 20.

The side wall 21*b* is provided so as to cover the side wall 22*b* of the housing 22 as illustrated in FIG. 5. The side wall 21*b* has a first part 21*x* and a second part 21*y*. The first part 21*x* extends in the Y-axis direction so as to sandwich the distal end portion of the electric cable 60 with the upper wall 21*a*. The second part 21*y* is contiguous with the front end of the first part 21*x* in the X-axis direction and is provided in conformity with the shape of the side wall 22*b* so as to cover the outer and inner surfaces of the side wall 22*b* in the X-axis direction. In some examples, the second part 21*y* extends downward along the outer surface of the side wall 22*b* from the front end of the first part 21*x*, curves in the direction of the inner surface of the side wall 22*b* at the lower end of the side wall 22*b*, and extends upward along the inner surface of the side wall 22*b*.

The front portion 21*c* covers the outer surface of the upper wall 22*d* of the housing 22 in the X-axis direction as illustrated in FIG. 5. The front portion 21*c* has a first part 21*v* and a second part 21*w*. The first part 21*v* is provided along the outer surface of the front end portion 21*z* of the upper wall 21*a* in the X-axis direction. The second part 21*w* is contiguous with the lower end of the first part 21*v*, extends rearward in the X-axis direction, and covers the lower surface of the upper wall 22*d*. As illustrated in FIG. 5, the second part 21*w* is in contact with the upper surface of the side wall 12*a* of the housing 12 of the receptacle connector 10 in the state where the plug connector 20 and the receptacle connector 10 are fitted together.

The ground contact portion 21*d* is provided so as to cover a part of the outer surface of the side wall 22*c* of the housing 22 in the Y-axis direction as illustrated in FIGS. 4 and 7B. As illustrated in FIG. 4, the ground contact portion 21*d* constitutes a part of a ground circuit by contact with the ground contact portion 11*z* of the receptacle connector 10 in the state where the plug connector 20 and the receptacle connector 10 are fitted together.

The bearing 21*e* holds a pivot shaft 34 (described in additional detail later) of the lock member 30. As illustrated in FIG. 5, the bearing 21*e* is provided in the front end portion of the upper wall 21*a* in the X-axis direction and is provided in the entire region in the Y-axis direction or at least both end portions in the Y-axis direction. The bearing 21*e* is provided close to or adjacent the lower surface of the upper wall 21*a*, has a U-shaped cross section hollowed out in the middle as illustrated in, for example, FIG. 5, and is formed so as to be capable of receiving (placing) the pivot shaft 34.

A pressed metallic and plate-shaped member or the like constitutes the plurality of conductive terminals 23. The plurality of conductive terminals 23 have conductivity. As illustrated in FIG. 7B, the plurality of conductive terminals 23 are arranged along the Y-axis direction. As illustrated in FIG. 5, each conductive terminal 23 extends along the X-axis direction and includes a connection portion 23*a*, an intermediate portion 23*b*, and a contact portion 23*c*.

The connection portion 23*a* extends on the upper end surface of the side wall 22*b* along the internal conductor 61 in the distal end portion of the electric cable 60 and is connected by solder or the like to the internal conductor 61 that is in an exposed state. The intermediate portion 23*b* connects the connection portion 23*a* and the contact portion 23*c*. The intermediate portion 23*b* is contiguous with the front end of the connection portion 23*a* in the X-axis direction. The intermediate portion 23*b* extends downward and then extends rearward (in the direction of the middle wall 12*c* of the receptacle connector 10) along the lower surface of the side wall 22*a*. The contact portion 23*c* is in contact with the conductive terminal 13 of the receptacle connector 10 in the fitted state of the receptacle connector 10 and the plug connector 20. The contact portion 23*c* is contiguous with the rear end of the intermediate portion 23*b* in the X-axis direction and extends upward along the side wall 22*a*.

Lock Member

The lock member 30 is described in further detail with reference to FIGS. 1 to 5, 7A, 7B, 8A, 8B, 11A, and 11B. The lock member 30 is attached to the plug connector 20 and is configured to maintain the fitted state where the plug connector 20 and the receptacle connector 10 are fitted together. As illustrated in FIGS. 1 to 3, for example, the lock member 30 faces the main surface 50*s* of the circuit board 50, extends along the Y-axis direction, and is attached to the plug connector 20.

A pressed metallic and plate-shaped member or the like constitutes the lock member 30. The lock member 30 has elasticity and conductivity. As illustrated in FIGS. 7A, 7B, 8A, and 8B, the lock member 30 includes a main body portion 31, two lock engagement portions 32 and 32, two release operation portions 33 and 33, the pivot shaft 34, and two connection portions 35 and 35.

Figure 8A:
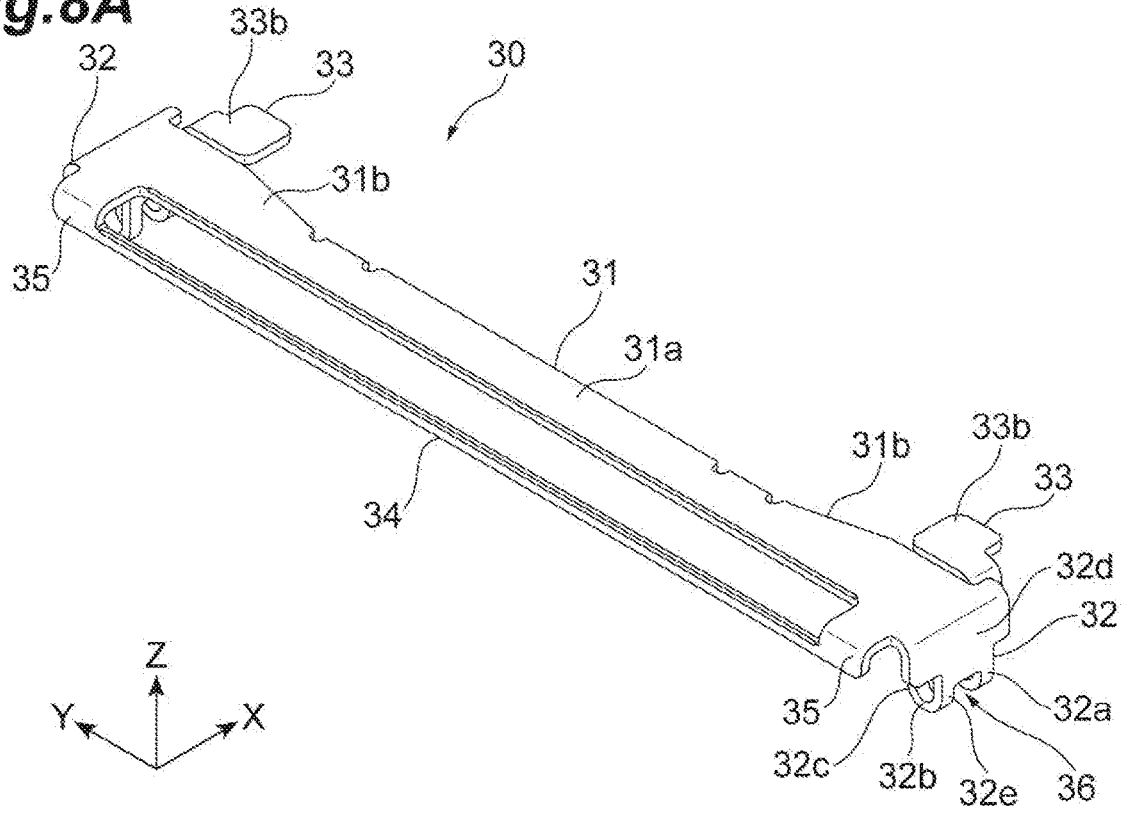
FIGS. 8A and 8B are perspective views illustrating the lock member included in the connector device in FIG. 1.

As illustrated in FIGS. 7A and 8A, the main body portion 31 is a plate-shaped member along the XY plane and is configured to sandwich the plug connector 20 that is fitted together with the receptacle connector 10 between the receptacle connector 10 and the main body portion 31. The main body portion 31 has a middle portion 31*a* having a substantially rectangular plate shape and extending in the Y-axis direction and two outer end portions 31*b* and 31*b* extending outward in the Y-axis direction from both end portions of the middle portion 31*a* in the Y-axis direction. The rear end portion of the outer end portion 31*b* in the X-axis direction extends so as to spread rearward in the X-axis direction as the rear end portion of the outer end portion 31*b* in the X-axis direction extends outward in the Y-axis direction.

The lock engagement portions 32 and 32 are members configured to be engageable with the connector engagement portions 11*g* and 11*g* disposed in the end portions 10*a* and 10*b* of the receptacle connector 10. In a case where the direction in which the electric cable 60 extends toward the plug connector 20 is forward in the X-axis direction and the direction in which the electric cable 60 extends away from the plug connector 20 is rearward in the X-axis direction, the lock engagement portions 32 and 32 are disposed close to the rear of the plug connector 20. Here, close to the rear means, for example, the region that is behind at least half of the entire region of the plug connector 20 in the X-axis direction. In some examples, the lock engagement portions 32 and 32 are disposed behind the pivot shaft 34 and in front of the release operation portions 33 and 33 in the X-axis direction, (that is, at positions sandwiched between the pivot shaft 34 and the release operation portions 33 and 33). As illustrated in FIGS. 7A, 7B, 8A, and 8B, the lock engagement portion 32 has a hanging portion 32*a*, a folded portion 32*b*, and an extending portion 32*c*.

The hanging portion 32*a* is a part extending downward (in the Z-axis direction that is toward the receptacle connector 10 in the fitted state) from the part of the main body portion 31 (outer end portion 31*b* to be specific) that is close to or adjacent the outside in the Y-axis direction. The hanging portion 32*a* has a first part 32*d* contiguous with the outer end (end portion close to or adjacent the outside) of the outer end portion 31*b* and extending downward and a second part 32*e* contiguous with the lower end of the first part 32*d* and extending downward. The second part 32*e* is approximately half of the first part 32*d* in length (width) in the X-axis direction. Further, the second part 32*e* is contiguous only with the middle part of the lower end of the first part 32*d* in the X-axis direction. A slit 36 is formed at the middle part of the second part 32*e* in the X-axis direction and the second part 32*e* bifurcates in the X-axis direction. The slit 36 is continuously formed up to the folded portion 32*b* (described in additional detail later) and the extending portion 32*c* (described in additional detail later). In this manner, the slit 36 is formed in the lock engagement portion 32.

The folded portion 32*b* is a part curving and extending so as to be folded back inward in the Y-axis direction from the lower end of the hanging portion 32*a* (e.g., the lower end of the second part 32*e* of the hanging portion 32*a*). As illustrated in FIG. 4, in the fitted state of the receptacle connector 10 and the plug connector 20, the position of the lower end of the folded portion 32*b* substantially coincides with the position of the lower end of the housing 12 of the receptacle connector 10 in the Z-axis direction (e.g., the lower end of the folded portion 32*b* is positioned slightly above the lower end of the housing 12). The slit 36 may also be formed, in the same manner as described above, at the middle part of the folded portion 32*b* in the X-axis direction.

Figure 8B:
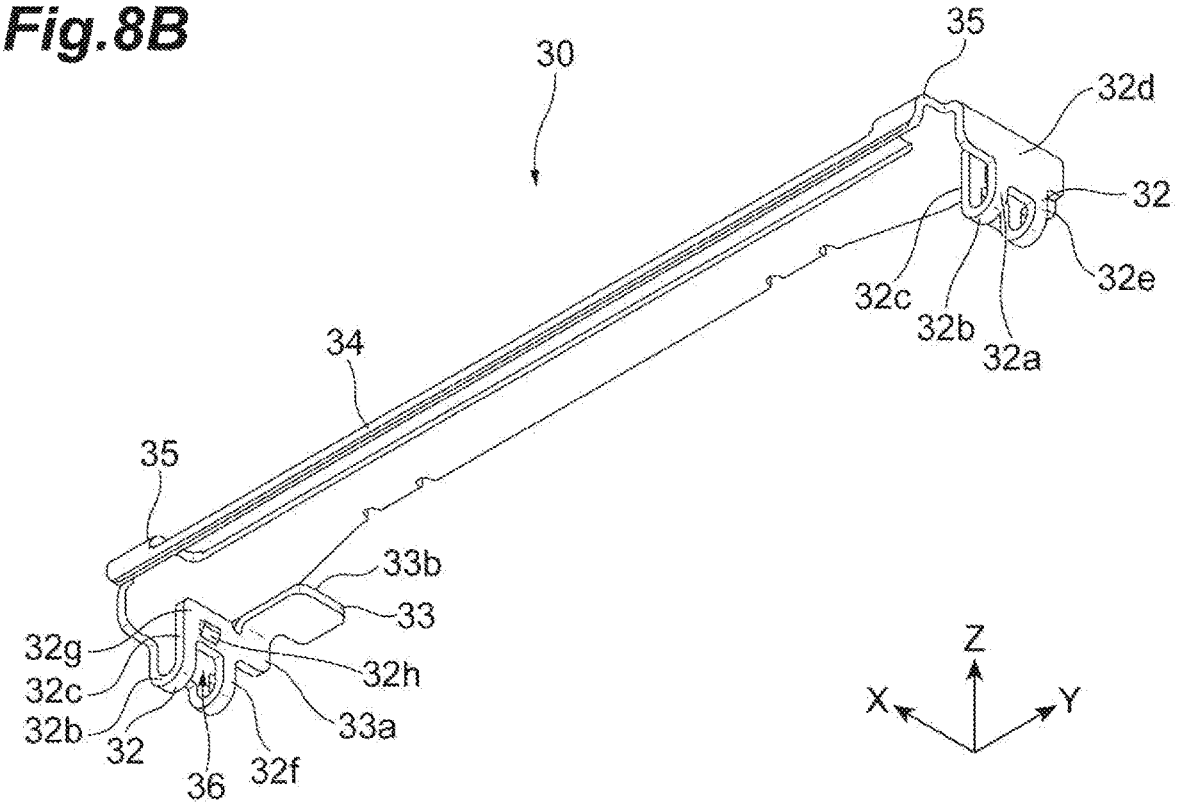

The extending portion 32*c* is a part extending upward (e.g., in the Z-axis direction that is away from the receptacle connector 10 in the fitted state) from the part of the folded portion 32*b* that is close to or adjacent the inside in the Y-axis direction. As illustrated in FIGS. 7B and 8B, the extending portion 32*c* has a first part 32*f* contiguous with the inner end (end portion close to or adjacent the inside) of the folded portion 32*b* and extending upward, a second part 32*g* contiguous with the upper end of the first part 32*f* and extending upward, and an engagement portion 32*h* (see FIGS. 7B and 8B). The slit 36 may also be formed, in the same manner as described above, at the middle part of the extending portion 32*c* in the X-axis direction. In some examples, the slit 36 is formed at the middle part of the first part 32*f* of the extending portion 32*c* in the X-axis direction (e.g., the slit 36 is not formed at the second part 32*g*). The engagement portion 32*h* is provided on the surface of the second part 32*g* that is on the inside in the Y-axis direction and is a protruding part protruding inward in the Y-axis direction. As illustrated in FIG. 4, the engagement portion 32*h* is engaged with the connector engagement portion 11*g* of the receptacle connector 10 in the fitted state.

As illustrated in FIG. 8B, the release operation portions 33 and 33 are connected to the lock engagement portions 32 and 32. The release operation portions 33 and 33 are parts configured to disengage the lock engagement portion 32 from the connector engagement portion 11*g* of the receptacle connector 10 (see FIG. 4). The release operation portions 33 and 33 are disposed close to or adjacent the rear of the plug connector 20 in the X-axis direction. In some examples, the release operation portions 33 and 33 are disposed behind the lock engagement portions 32 and 32 in the X-axis direction. As illustrated in FIGS. 8A and 8B, the release operation portion 33 has an overhang 33*a* and an operation portion 33*b*.

Figure 11A:
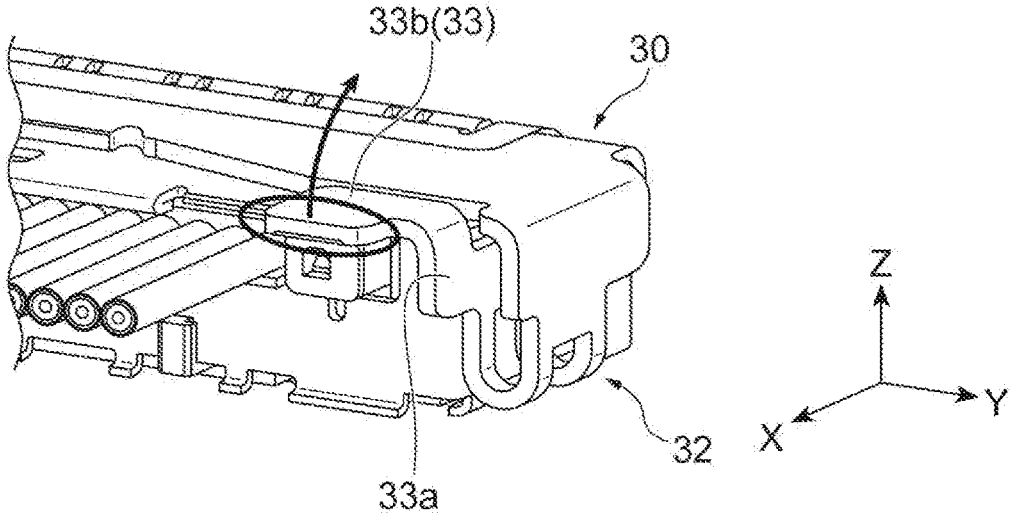
FIGS. 11A and 11B are perspective views schematically illustrating an example connector device lock release procedure.
Figure 11B:
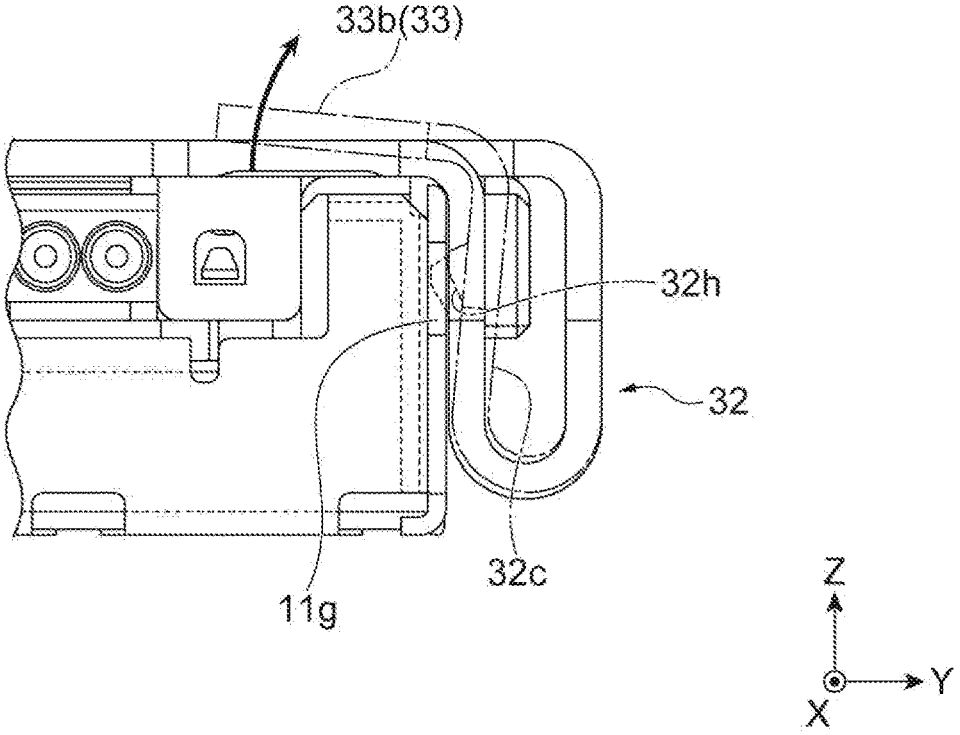

As illustrated in FIG. 8B, the overhang 33*a* is a part contiguous with the second part 32*g* of the extending portion 32*c* of the lock engagement portion 32 and extending rearward in the X-axis direction. In some examples, the overhang 33*a* is a part contiguous with the rear end of the first part 32*f* in the X-axis direction and extending rearward. As illustrated in FIG. 8B, the operation portion 33*b* is a part contiguous with the upper end of the overhang 33*a* and extending inward in the Y-axis direction. The upper surface (e.g., main surface) of the operation portion 33*b* is disposed so as to be substantially flush with the upper surface of the main body portion 31 (e.g., the outer end portion 31*b* of the main body portion 31). The operation portion 33*b* of the release operation portion 33 is operated upward as illustrated in FIG. 11A. As a result, the extending portion 32*c* connected to the operation portion 33*b* via the overhang 33*a* is displaced outward in the Y-axis direction and the engagement portion 32*h* provided on the extending portion 32*c* is also displaced outward in the Y-axis direction as illustrated in FIG. 11B. Accordingly, engagement between the engagement portion 32*h* and the connector engagement portion 11*g* of the receptacle connector 10 is released as illustrated in FIG. 11B.

The pivot shaft 34 extends along the Y-axis direction as illustrated in FIGS. 8A and 8B. The pivot shaft 34 is disposed close to the front of the plug connector 20 as illustrated in FIG. 5. Here, close to the front means, for example, the region that is in front of at least half of the entire region of the plug connector 20 in the X-axis direction. The pivot shaft 34 is connected to the main body portion 31 via the connection portions 35 and 35 provided at the front end of the main body portion 31 in the X-axis direction and in both end portions of the main body portion 31 in the Y-axis direction. The connection portion 35 is provided so as to curve downward from the main body portion 31 toward the pivot shaft 34. As illustrated in FIG. 5, the pivot shaft 34 is placed on the bearing 21*e* and held by being sandwiched between the bearing 21*e* and the upper wall 21*a*. As a result, the lock member 30 is attached to the plug connector 20 so as to be pivotable about the pivot shaft 34.

Fitted State

Next, the fitted state of the receptacle connector 10 and the plug connector 20 are described with reference to FIGS. 4 and 5. As illustrated in FIG. 5, the protrusion W1 (side wall 22*a*) of the plug connector 20 is accommodated in the recess V1 of the receptacle connector 10 and the protrusion W2 (side wall 22*b*) of the plug connector 20 is accommodated in the recess V2 of the receptacle connector 10 when the plug connector 20 is fitted to the receptacle connector 10.

As illustrated in FIG. 5, the conductive terminals 13 and 23 are electrically connected to each other in the fitted state by contact between the contact portion 13*c* of the conductive terminal 13 of the receptacle connector 10 and the contact portion 23*c* of the conductive terminal 23 of the plug connector 20. In addition, ground connection is performed in the fitted state by contact between the ground contact portion 11*z* of the receptacle connector 10 and the ground contact portion 21*d* of the plug connector 20 as illustrated in FIG. 4.

Further, the engagement portion 32*h* provided on the extending portion 32*c* of the lock engagement portion 32 of the lock member 30 is engaged with the connector engagement portion 11*g* of the receptacle connector 10 in the fitted state, as illustrated in FIG. 4. As a result, the lock member 30 attached to the plug connector 20 is connected to the receptacle connector 10, and thus the fitted state of the receptacle connector 10 and the plug connector 20 can be firmly maintained.

Fitting Procedure

Figure 9A:
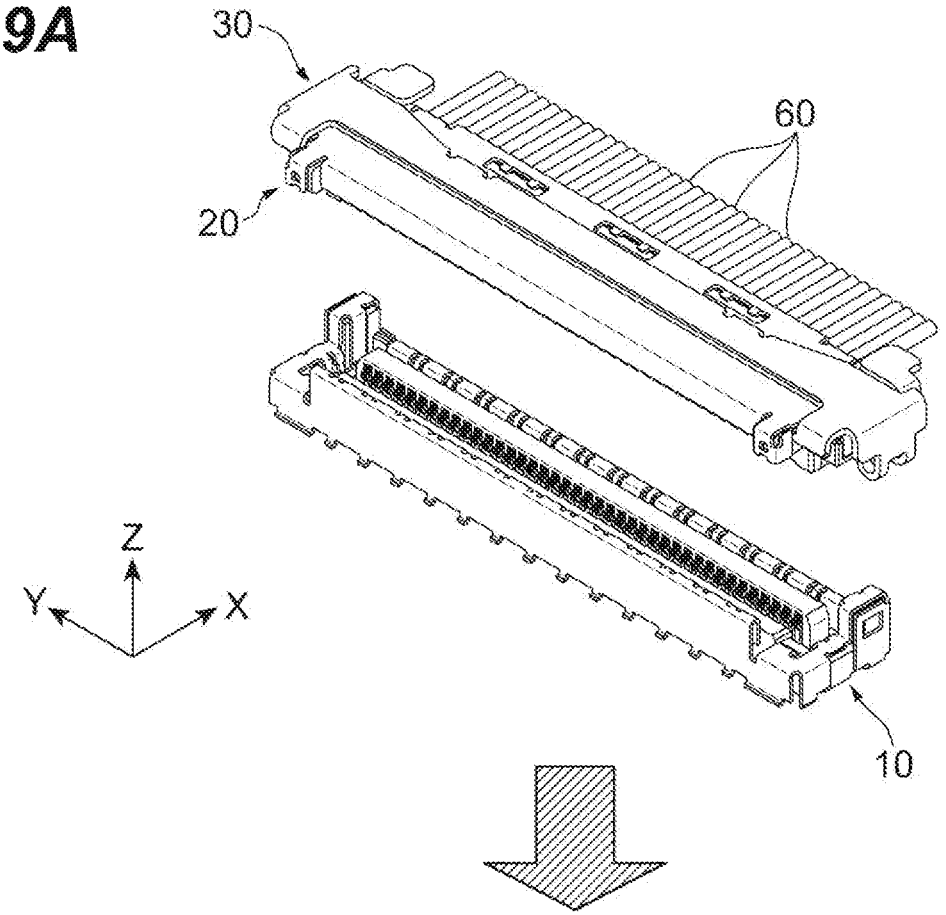
FIGS. 9A and 9B are perspective views schematically illustrating an example connector device fitting procedure.
Figure 9B:
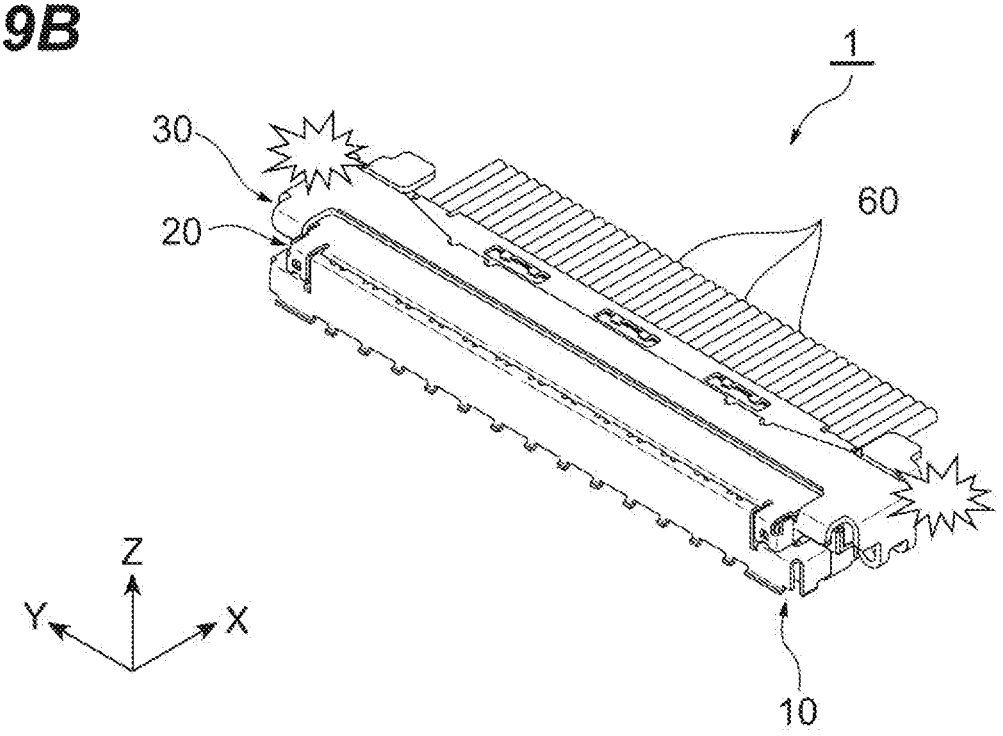

Next, an example procedure for fitting the plug connector 20 to the receptacle connector 10 (hereinafter, referred to as "fitting procedure") is described with reference to FIGS. 9A and 9B. First, the receptacle connector 10 and the plug connector 20 that are in a separated state (pre-fitting state) are disposed so as to face each other in the Z-axis direction as illustrated in FIG. 9A. Subsequently, the plug connector 20 is moved in the fitting direction along the Z-axis direction and the plug connector 20 is fitted to the receptacle connector 10 as illustrated in FIG. 9B. By the fitting of the plug connector 20 to the receptacle connector 10 being completed, the engagement portion 32*h* of the lock member 30 engages with the connector engagement portion 11*g* of the receptacle connector 10 as illustrated in FIG. 4. As a result, the fitted state of the receptacle connector 10 and the plug connector 20 is maintained by the lock member 30. The fitting procedure is completed as a result, and then the connector device 1 is in the state that is illustrated in FIGS. 1 to 3.

Removal Procedure

Figure 10A:
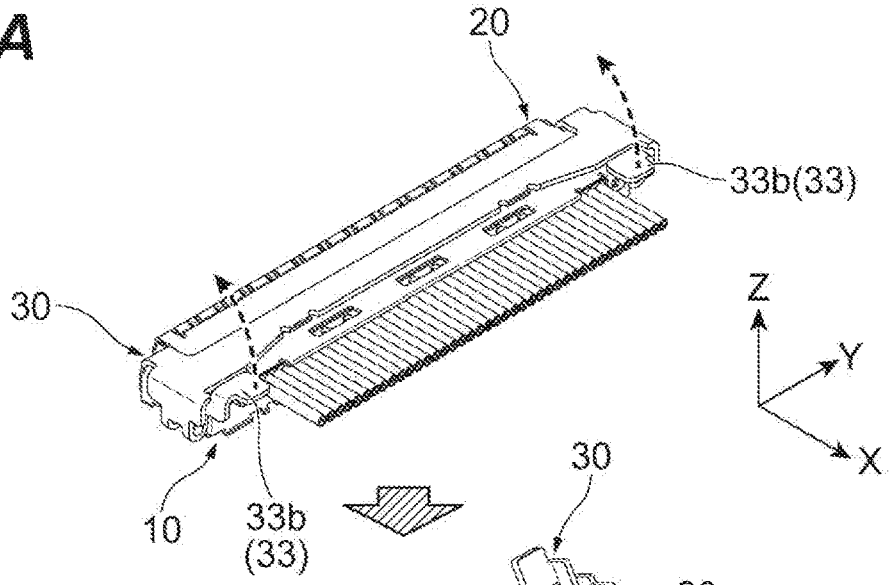
FIGS. 10A to 10C are perspective views schematically illustrating an example connector device removal procedure.
Figure 10B:
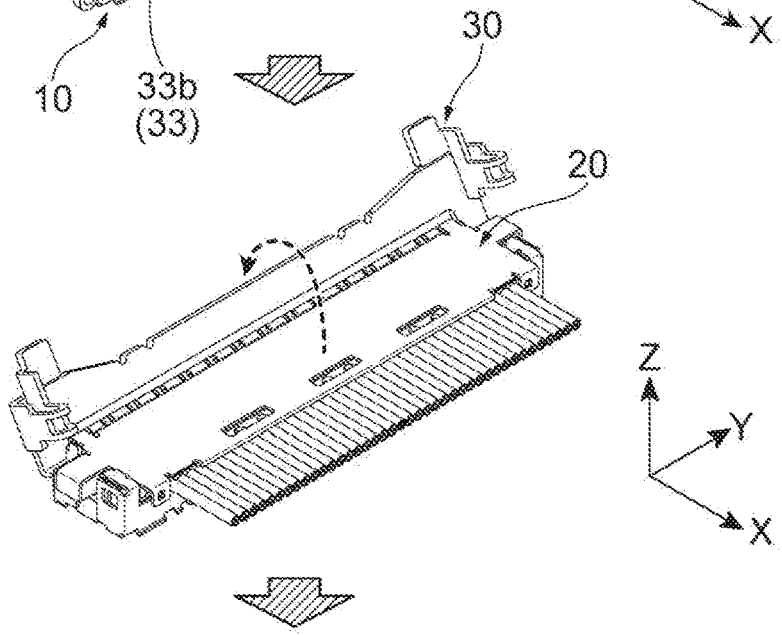

Next, an example procedure for removing the plug connector 20 from the receptacle connector 10 (hereinafter, referred to as "removal procedure") is described with reference to FIGS. 10A to 10C, 11A, and 11B. First, the operation portion 33*b* of the release operation portion 33 of the lock member 30 is lifted, as illustrated in FIGS. 10A and 11A. As a result, the extending portion 32*c* connected to the operation portion 33*b* is displaced outward in the Y-axis direction and the engagement portion 32*h* provided on the extending portion 32*c* is also displaced outward in the Y-axis direction as illustrated in FIG. 11B. As a result, engagement between the engagement portion 32*h* and the connector engagement portion 11*g* of the receptacle connector 10 is released as illustrated in FIG. 11B. The engagement is released as a result of the operation for lifting the operation portion 33*b*. Further, the lock member 30 rotates about the pivot shaft 34 as illustrated in FIG. 10B.

Figure 10C:
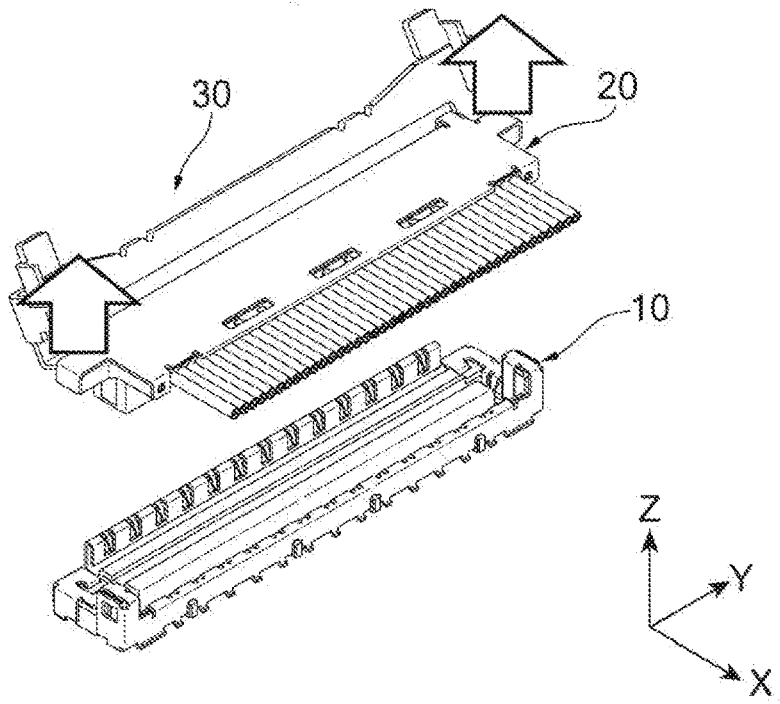

Subsequently, the plug connector 20 is removed from the receptacle connector 10 as illustrated in FIG. 10C. For example, the operation for removing the plug connector 20 from the receptacle connector 10 is performed by the plug connector 20 being pulled up in the direction along the Z-axis direction (upward direction to be specific). The removal procedure is completed as a result.

Action

As described above, the connector device 1 may be provided with the plug connector 20 configured to be fitted to the receptacle connector 10 along the Z-axis direction, the electric cable 60 extending in the X-axis direction being connected to the plug connector 20, and the lock member 30 attached to the plug connector 20. Additionally, the lock member 30 may be configured to maintain the fitted state where the plug connector 20 and the receptacle connector 10 are fitted together, in which the lock member 30 has the main body portion 31 configured to sandwich the plug connector 20 in the fitted state between the receptacle connector 10 and the main body portion 31. In some examples, the lock engagement portions 32 and 32 may be configured to be engageable with the connector engagement portions 11*g* and 11*g* provided in the receptacle connector 10, and the lock engagement portion 32 may have the hanging portion 32*a* extending downward from the part of the main body portion 31 close to or adjacent the outside in the Y-axis direction. Still further, the folded portion 32*b* may extend so as to be folded back inward in the Y-axis direction from the lower end of the hanging portion 32*a*, and the extending portion 32*c* may extend upward from the part of the folded portion 32*b* close to or adjacent the inside in the Y-axis direction and including the engagement portion 32*h* engaging with the connector engagement portion 11*g*.

In some examples, the lock engagement portion 32 of the lock member 30 and the connector engagement portion 11*g* of the receptacle connector 10 can be engaged with each other. As a result, the lock member 30 may be connected to the receptacle connector 10, and thus a removal-direction movement of the plug connector 20 sandwiched between the receptacle connector 10 and the lock member 30 is regulated. Accordingly, the fitted state may be maintained even when an external force attributable to bending or the like acts on the plug connector 20 through the electric cable 60. Further, the lock engagement portion 32 has the hanging portion 32*a* extending downward, the folded portion 32*b* folded back inward from the lower end of the hanging portion 32*a*, and the extending portion 32*c* extending upward from the inner end (end portion close to or adjacent the inside) of the folded portion 32*b* and is formed in a substantially U-shape. The engagement state of the engagement portion 32*h* of the lock engagement portion 32 and the connector engagement portion 11*g* of the receptacle connector 10 is released during the removal process and the lock engagement portion 32 is displaced (bent) when the engagement state is released. By the lock engagement portion 32 being formed in a U-shape as described above, the spring length of the lock engagement portion 32 (length of the part functioning as a spring) can be selectively increased and the engagement release operation can be performed with predetermined force under limited connector height conditions. Accordingly, the fitted state may be maintained even when the external force acts and the operability may be preserved during the removal process.

The slit 36 may be formed in the lock engagement portion 32. As a result, the lock engagement portion 32 can be readily bent and the operability during the removal process and the like can be preserved.

The lock engagement portion 32 is disposed close to or adjacent the rear of the plug connector 20 in the X-axis direction. In the plug connector 20, an external force in a direction away from the receptacle connector 10 (external force attributable to bending) is likely to be applied to the part close to or adjacent the rear to which the electric cable 60 is attached in a case where the electric cable 60 is displaced by the part of the electric cable 60 close to or adjacent the plug connector 20 being lifted (in the case of so-called bending reception). The lock engagement portion 32 is disposed close to or adjacent the rear of the plug connector 20 in this regard, and thus the fitted state can be maintained even in a case where the external force attributable to bending acts.

The lock member 30 further has the release operation portions 33 and 33 connected to the lock engagement portion 32 and configured such that the operation for disengaging the lock engagement portion 32 from the connector engagement portion 11*g* is performed. Engagement between the connector engagement portion 11*g* and the lock engagement portion 32 can be released by the release operation portion 33 to facilitate operability during the removal process.

The release operation portion 33 is disposed close to or adjacent the rear of the plug connector 20. The electric cable 60 extends behind the plug connector 20. As a result of the disposition of the release operation portion 33 at the position close to or adjacent the rear where another member (e.g., electric cable 60) is provided, the space on the circuit board 50 on which the receptacle connector 10 is mounted can be effectively used.

The release operation portion 33 releases an engagement between the connector engagement portion 11*g* and the lock engagement portion 32 by being operated upward. In examples in which engagement between the connector engagement portion 11*g* and the lock engagement portion 32 is released by the release operation portion 33 being pressed, the pressing may cause a high load to be applied to a solder part of the circuit board 50 on which the receptacle connector 10 is mounted by solder or the like. The configuration in which the release operation portion 33 is operated upward is adopted in this regard, and thus it is possible to release the engagement while reducing the load on the circuit board 50 and avoiding connection failures.

The lock member 30 is attached to the plug connector 20 so as to be pivotable about the pivot shaft 34 extending along the Y-axis direction. The lock may be readily released by the lock member 30 pivoting around the pivot shaft 34, and thus the removal work can be further facilitated. In addition, dissipation of parts can be suppressed since the lock member 30 is attached to the plug connector 20 via the pivot shaft 34.

The pivot shaft 34 of the lock member 30 is disposed close to or adjacent the front of the plug connector 20 to maintain a predetermined distance between the pivot shaft 34 disposed close to or adjacent the front and the release operation portion 33 disposed close to or adjacent the rear. Accordingly, the lock may be readily released by pivoting the lock member 30 about the pivot shaft 34.

The lock engagement portion 32 is disposed between the pivot shaft 34 and the release operation portion 33 in the X-axis direction. As a result, the release operation portion 33, the lock engagement portion 32, and the pivot shaft 34 may be sequentially disposed from the rear toward the front. During the lock release, the lock member 30 is pivoted after the engagement of the connector engagement portion 11*g* and the lock engagement portion 32 is released by the release operation portion 33 being operated. The above-described disposition may result in a sequential operation from the configuration disposed in the rear toward the configuration disposed in the front.

The upper surface (e.g., main surface) of the operation portion 33*b* of the release operation portion 33 is disposed so as to be substantially flush with the upper surface of the main body portion 31 (e.g., outer end portion 31*b* of the main body portion 31). To facilitate operation of the release operation portion 33, the release operation portion 33 may not be disposed at an extremely low part of the connector. The height of the connector device 1 may be increased as a result of the release operation portion 33 being provided above the main body portion 31. In some examples, the main surface of the release operation portion 33 is disposed so as to be substantially flush with the main surface of the main body portion 31 to avoid an increase in the height of the connector device 1 attributable to the location of the release operation portion 33.

Figure 12A:
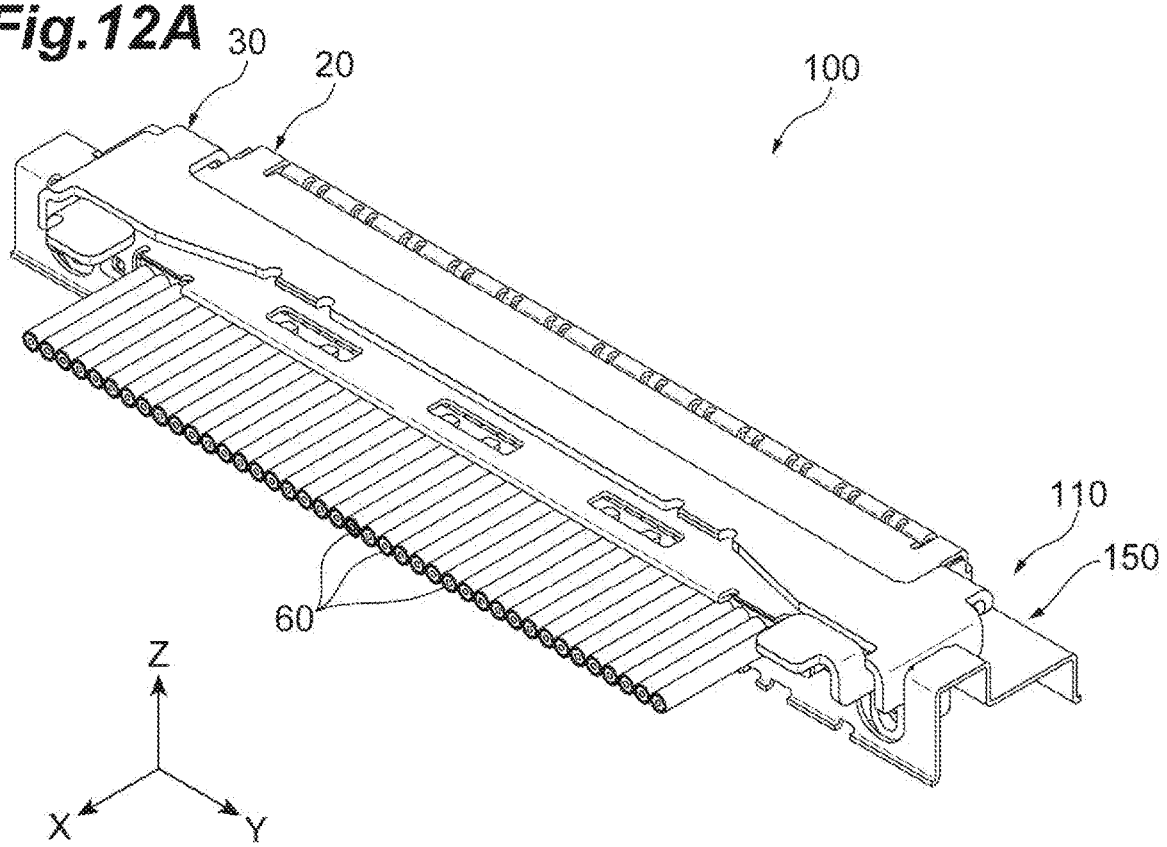
FIGS. 12A and 12B are perspective views illustrating another example connector device.
Figure 12B:
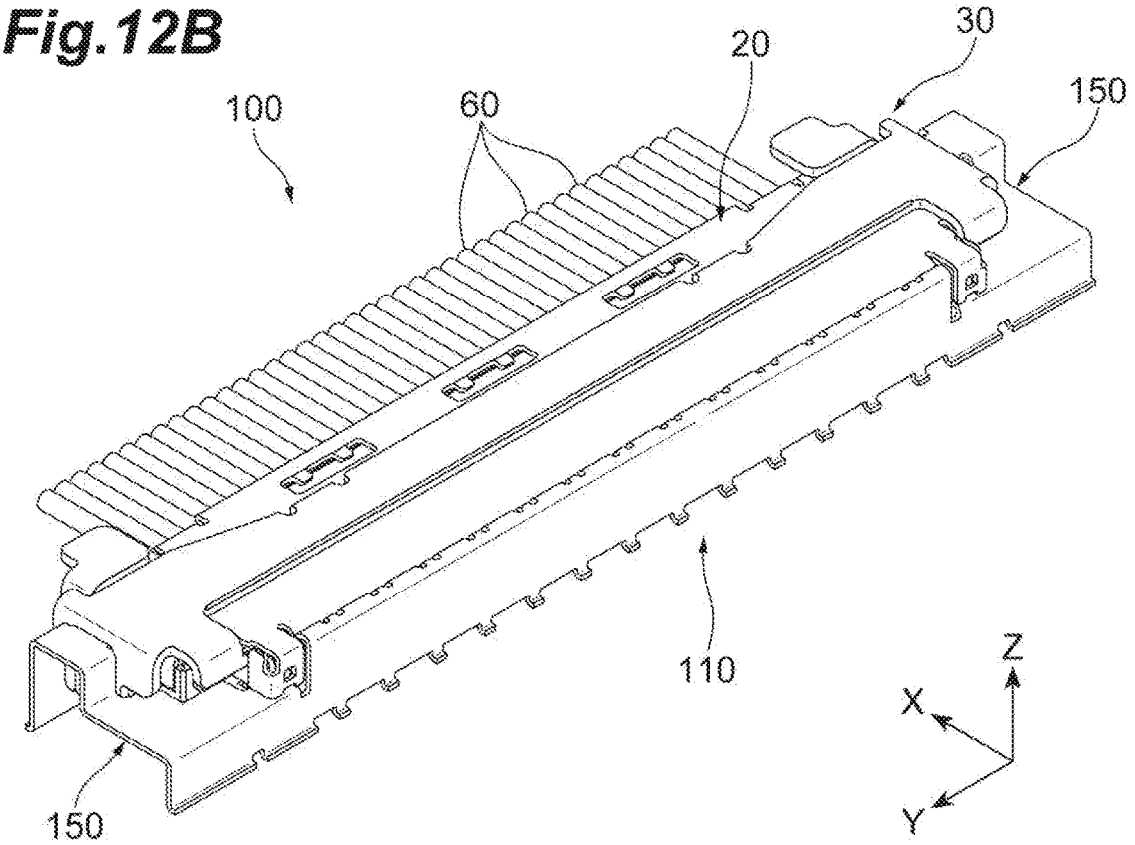
Figure 13:
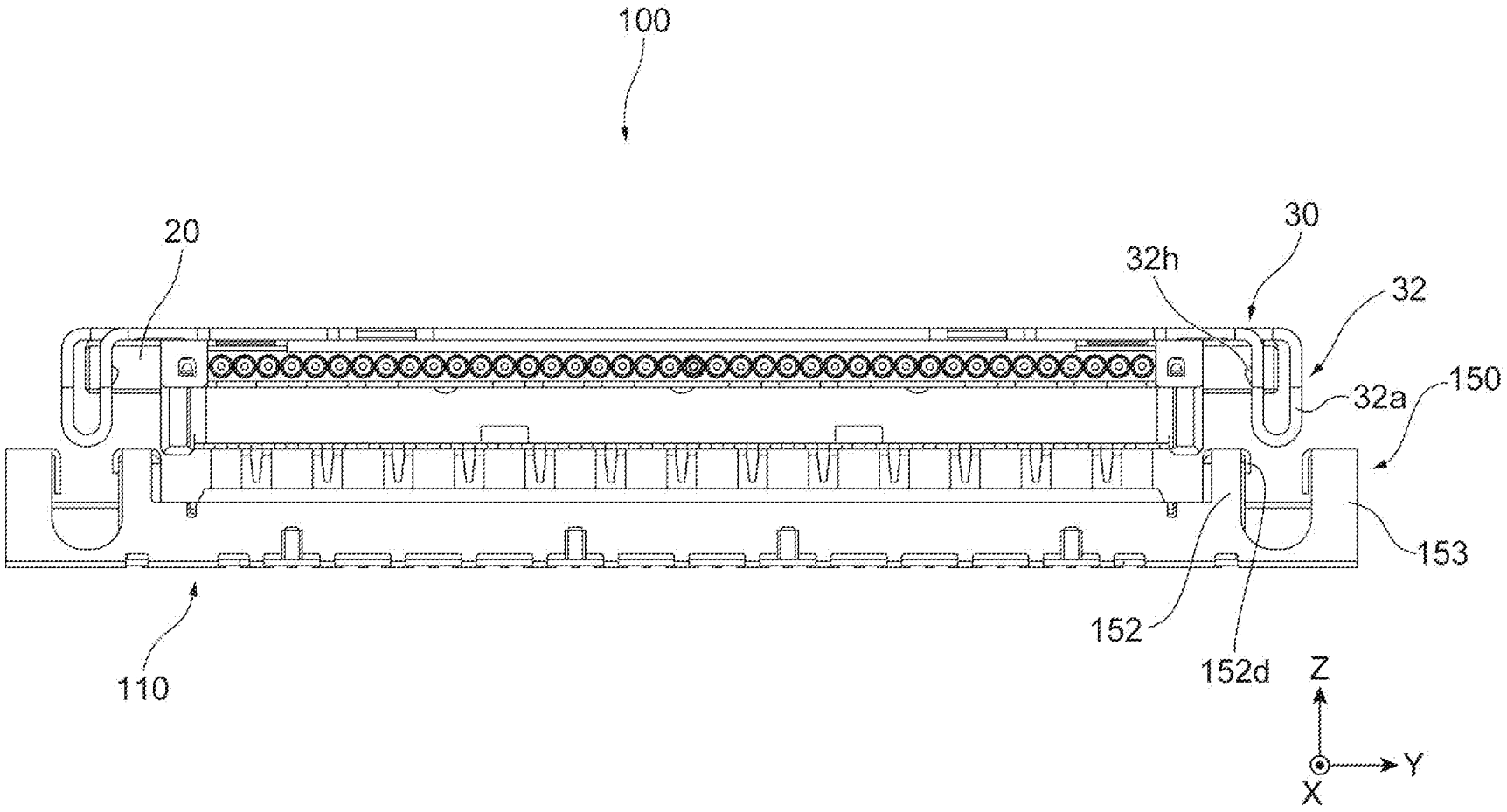
FIG. 13 is a rear view of the connector device (before fitting) in FIG. 12.
Figure 14A:
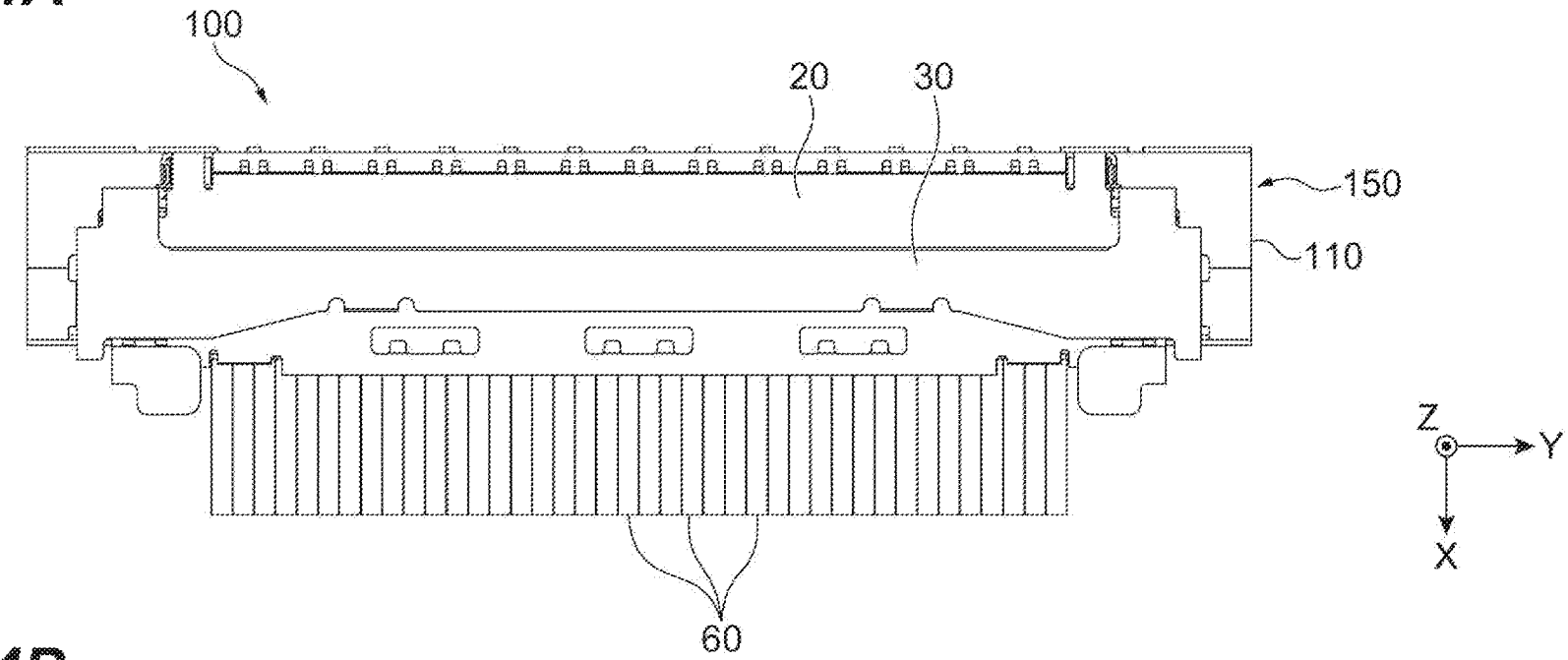
FIG. 14A is a plan view and FIG. 14B is a rear view.
Figure 14B:
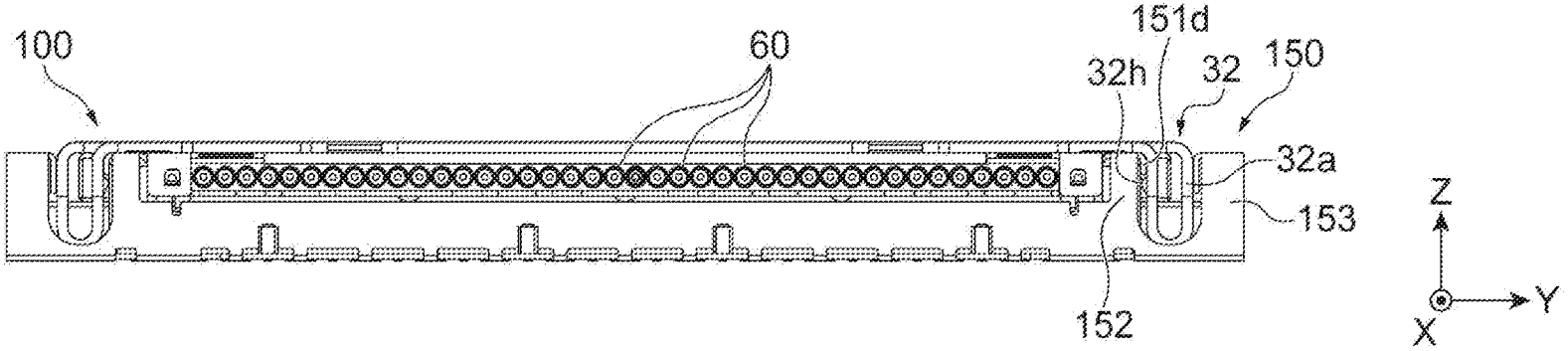
Figure 15A:
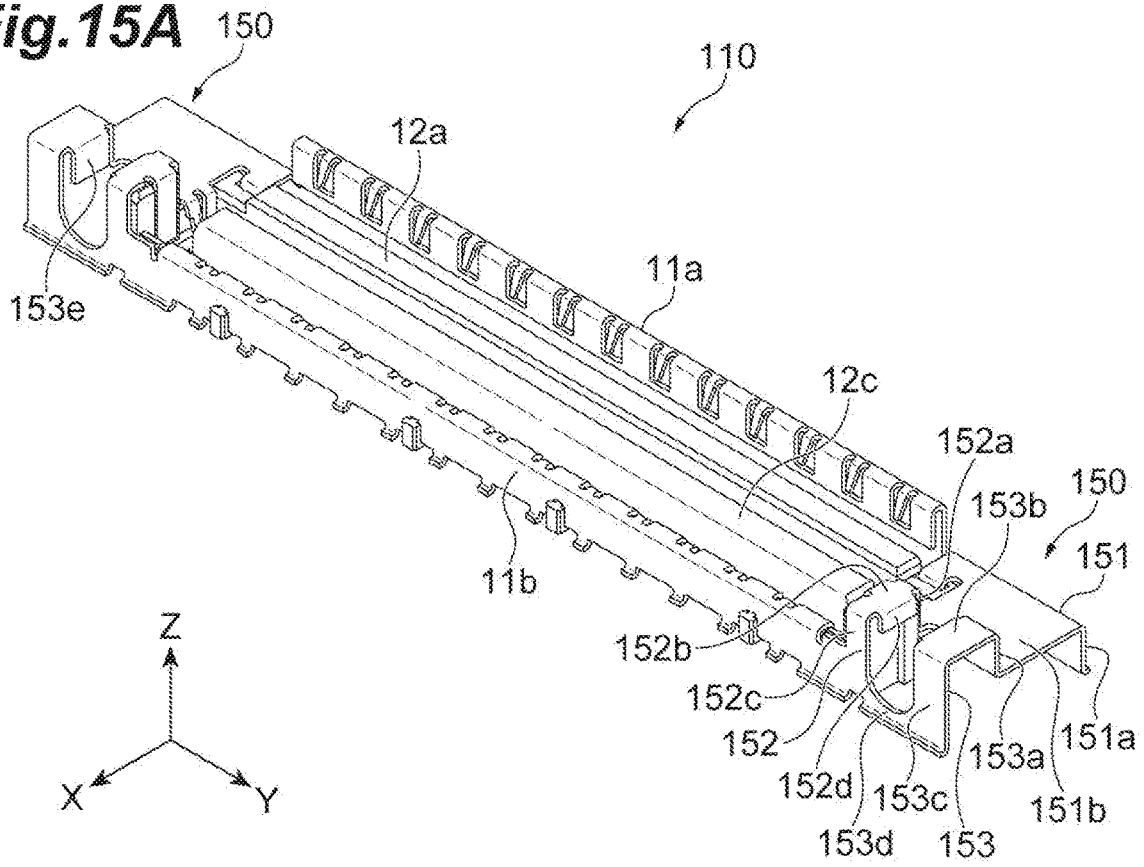
FIGS. 15A and 15B are perspective views illustrating an example receptacle connector included in the connector device in FIG. 12.
Figure 15B:
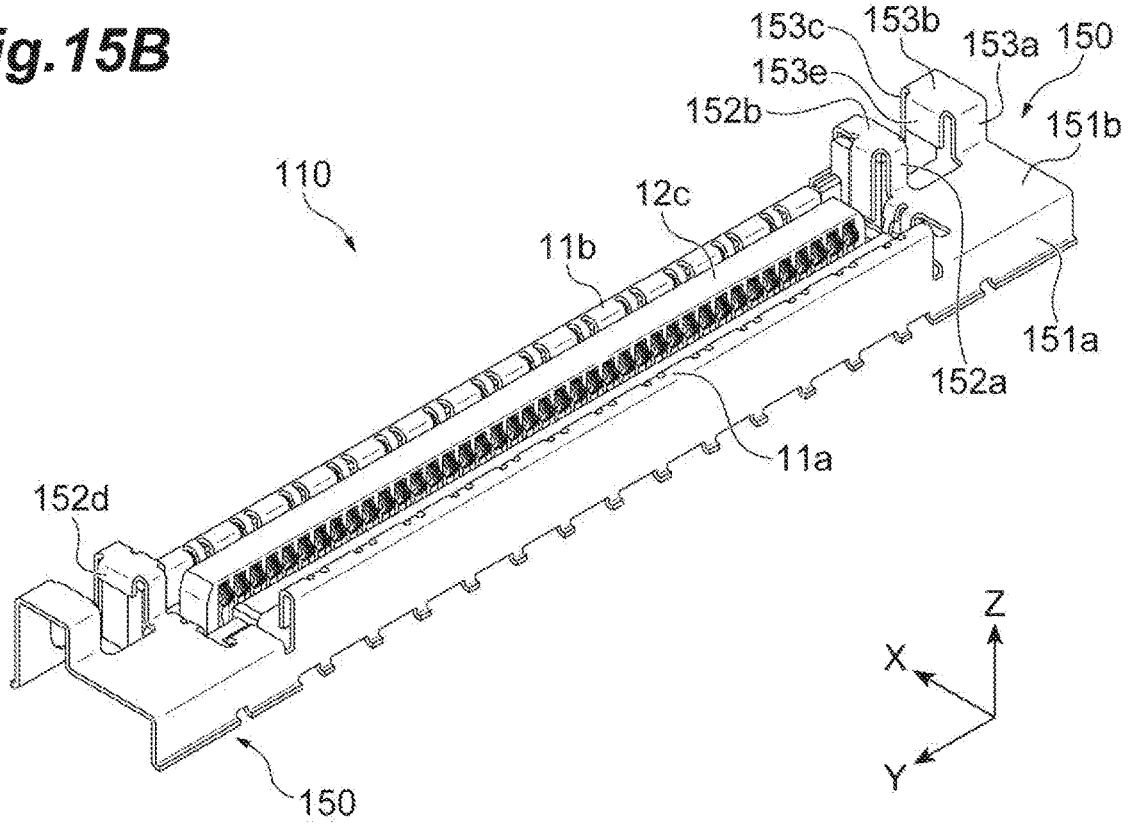

Hereinafter, another example connector is described with reference to FIGS. 12A, 12B, 13, 14A, 14B, 15A, and 15B. FIGS. 12A and 12B are perspective views illustrating an example connector device 100. FIG. 13 is a rear view of the connector device 100 (before fitting) in FIG. 12. FIG. 14 is a diagram illustrating the connector device 100 (fitted state) in FIG. 12, in which FIG. 14A is a plan view and FIG. 14B is a rear view. FIGS. 15A and 15B are perspective views illustrating a receptacle connector 110 included in the connector device 100 in FIG. 12.

As illustrated in FIGS. 12A, 12B, 13, 14A, 14B, 15A, and 15B, the connector device 100 is provided with the receptacle connector 110 (first connector), the plug connector 20 (second connector), and the lock member 30. The plug connector 20 and the lock member 30 in the connector device 100 may be configured similarly to the plug connector 20 and the lock member 30 in the connector device 1.

As illustrated in FIGS. 15A and 15B, the receptacle connector 110 is provided with two side walls 150 and 150 in place of the side walls 11*c* and 11*c* of the receptacle connector 10. The side walls 150 and 150 face each other in the Y-axis direction and extend along the X-axis direction. The side wall 150 has a base portion 151, a connector engagement portion 152, and a protective portion 153.

The base portion 151 has a first part 151*a* and a second part 151*b*. The first part 151*a* extends outward in the Y-axis direction so as to be contiguous with the outer surface of the side wall 11*a*. The second part 151*b* is contiguous with the upper end of the first part 151*a* and extends rearward in the X-axis direction.

The connector engagement portion 152 is configured to be engageable with the lock engagement portion 32 of the lock member 30. As illustrated in FIGS. 15A and 15B, the connector engagement portion 152 is provided so as to be contiguous with the part that is close to or adjacent the rear of the second part 151*b* of the base portion 151 in the X-axis direction and close to or adjacent the inside of the second part 151*b* of the base portion 151 in the Y-axis direction (part heading inward from the outer end). The connector engagement portion 152 has a first part 152*a*, a second part 152*b*, a third part 152*c*, and an engagement portion 152*d*. The first part 152*a* is a part contiguous with the second part 151*b* of the base portion 151 and extending upward. The second part 152*b* is a part contiguous with the upper end of the first part 152*a* and extending rearward in the X-axis direction. The third part 152*c* is a part contiguous with the rear end of the second part 152*b* in the X-axis direction and extending downward. The third part 152*c* is contiguous with the outer surface of the side wall 11*b*. The engagement portion 152*d* is a part contiguous with the outer end (e.g., end portion close to or adjacent the outside) of the second part 152*b* in the Y-axis direction and curving and extending downward from the outer end. The engagement portion 152*d* is a part engaging with the lock engagement portion 32 of the lock member 30.

As illustrated in FIGS. 13 and 14B, the protective portion 153 is a part positioned outside the hanging portion 32*a* in the Y-axis direction in a state where the receptacle connector 110 and the plug connector 20 are fitted together. In some examples, the protective portion 153 is provided at a position where the lock engagement portion 32 of the lock member 30 is sandwiched between the connector engagement portion 152 and the protective portion 153 (e.g., the outermost side in the Y-axis direction in the connector device 100 that is in the fitted state). The protective portion 153 is a conductive shell because the protective portion 153 is a configuration of the side wall 150.

As illustrated in FIGS. 15A and 15B, the protective portion 153 is provided so as to be contiguous with the part that is close to or adjacent the rear end portion of the second part 151*b* of the base portion 151 in the X-axis direction and close to or adjacent the outer end portion of the second part 151*b* of the base portion 151 in the Y-axis direction. The protective portion 153 has a first part 153*a*, a second part 153*b*, a third part 153*c*, a fourth part 153*d*, and a fifth part 153*e*. The first part 153*a* is a part contiguous with the second part 151*b* of the base portion 151 and extending upward. The second part 153*b* is a part contiguous with the upper end of the first part 153*a* and extending rearward in the X-axis direction. The third part 153*c* is a part contiguous with the rear end of the second part 153*b* in the X-axis direction and extending downward. The fourth part 153*d* is a part extending in the Y-axis direction and is a part connecting the lower end of the third part 153*c* and the lower end of the third part 152*c* of the connector engagement portion 152. The fifth part 153*e* is a part contiguous with the inner end (end portion close to or adjacent the inside) of the second part. 153*b* in the Y-axis direction and curving and extending downward from the inner end (end portion close to or adjacent the inside). The fifth part 153*e* of the protective portion 153 faces the engagement portion 152*d* of the connector engagement portion 152 in the Y-axis direction.

In some examples, the protective portion 153 is provided outside the hanging portion 32*a* in the Y-axis direction as illustrated in FIG. 14B in the state where the receptacle connector 110 and the plug connector 20 are fitted together. In a case where the lock engagement portion 32 is deformed outward in the Y-axis direction, for example, engagement between the lock engagement portion 32 and the connector engagement portion 152 may not be reliably performed. The protective portion 153 is provided outside the lock engagement portion 32 (specifically, outside the hanging portion 32*a* positioned on the outermost side in the Y-axis direction in the lock engagement portion 32) in this regard to prevent an outward deformation of the lock engagement portion 32. In addition, even in a case where the lock engagement portion 32 is deformed, the protective portion 153 (fifth part 153*e* of the protective portion 153 (see FIG. 15A)) is capable of hitting the hanging portion 32*a* and correcting the lock engagement portion 32 inward in the Y-axis direction during the fitting, and thus engagement between the lock engagement portion 32 and the connector engagement portion 152 can be reliably performed.

In some examples, the protective portion 153 is provided at a position where the lock engagement portion 32 is sandwiched between the protective portion 153 and the connector engagement portion 152. As a result, the protective portion 153 is disposed outside the place of engagement between the lock engagement portion 32 and the connector engagement portion 152 during the fitting, to prevent an outward deformation of the lock engagement portion 32 and the inward correction of the lock engagement portion 32.

Further, the protective portion 153 is formed from the side wall 150 and is a part of a conductive shell that operates to provide protection without an increase in the number of parts.

What is claimed is:

1. An electrical connector comprising:

a connector portion configured to be fitted to an opposing connector along a first direction;

a connection body connected to the connector portion and extending in a second direction perpendicular to the first direction; and a lock member attached to the connector portion and configured to maintain a fitted state between the connector portion and the opposing connector, wherein the lock member includes:

a main body portion configured to sandwich the connector portion between the opposing connector and the lock member in the fitted state;

at least one lock engagement portion configured to be engageable with at least one connector engagement portion provided in the opposing connector; and at least one release operation portion connected to the lock engagement portion and configured to disengage the connector engagement portion from the lock engagement portion, wherein the lock engagement portion includes:

a hanging portion extending from the main body portion in the first direction;

a folded portion extending from a lower end of the hanging portion and folded in a third direction perpendicular to both the first direction and the second direction; and an extending portion extending from the folded portion toward the main body, and including an engagement portion to engage the connector engagement portion, wherein the lock engagement portion is located at a rear of the connector portion which connects to the connection body, and wherein the lock member is attached to the connector portion so as to be pivotable about a pivot shaft extending along the third direction.

2. The electrical connector according to claim 1, wherein a slit is formed in the lock engagement portion.

3. The electrical connector according to claim 1, wherein the release operation portion is located at the rear of the connector portion.

4. The electrical connector according to claim 1, wherein the release operation portion is configured to release the engagement between the connector engagement portion and the lock engagement portion by being displaced upward.

5. The electrical connector according to claim 1, wherein the pivot shaft of the lock member is located at a front of the connector portion opposite the connection body.

6. The electrical connector according to claim 5, wherein the lock engagement portion is located between the pivot shaft and the release operation portion in the second direction.

7. A connector device comprising:

the electrical connector of claim 1; and the opposing connector fitted to the electrical connector along the first direction in the fitted state.

8. The connector device according to claim 7, wherein the opposing connector has a protective portion positioned outside the hanging portion in the third direction in the fitted state.

9. The connector device according to claim 8, wherein the lock engagement portion is sandwiched between the connector engagement portion and the protective portion.

10. The connector device according to claim 8, wherein the protective portion is a part of a conductive shell covering at least part of an outer surface of the opposing connector.

11. An electrical connector comprising:

a connector portion configured to be fitted to an opposing connector along a first direction;

a connection body connected to the connector portion and extending in a second direction perpendicular to the first direction; and a lock member attached to the connector portion and configured to maintain a fitted state between the connector portion and the opposing connector, wherein the lock member includes:

a main body portion configured to sandwich the connector portion between the opposing connector and the lock member in the fitted state;

at least one lock engagement portion configured to be engageable with at least one connector engagement portion provided in the opposing connector; and at least one release operation portion connected to the lock engagement portion and configured to disengage the connector engagement portion from the lock engagement portion, wherein the lock engagement portion includes:

a hanging portion extending from the main body portion in the first direction;

a folded portion extending from a lower end of the hanging portion and folded in a third direction perpendicular to both the first direction and the second direction; and an extending portion extending from the folded portion toward the main body, and including an engagement portion to engage the connector engagement portion, wherein the lock engagement portion is located at a rear of the connector portion which connects to the connection body, and wherein a main surface of the release operation portion is substantially flush with a main surface of the main body portion.

12. An electrical connector comprising:

a connector portion configured to be fitted to an opposing connector; and a lock member attached to the connector portion and configured to maintain a fitted state between the connector portion and the opposing connector, wherein the lock member includes:

a main body portion configured to sandwich the connector portion between the opposing connector and the lock member in the fitted state;

a hanging portion extending away from the main body portion in a downward direction;

a folded portion extending inward from a lower end of the hanging portion in an inward direction that is perpendicular to the downward direction; and an extending portion extending from the folded portion toward the main body, the extending portion including an engagement portion configured to engage the opposing connector, wherein the lock member is attached to the connector portion so as to be pivotable about a pivot shaft extending along the inward direction.

13. The electrical connector according to claim 12, wherein the hanging portion, the folded portion, and the extending portion collectively form a U-shaped lock engagement portion.

14. The electrical connector according to claim 13, wherein the lock engagement portion comprises a slit to facilitate a locking operation in which the lock engagement portion bends when the connector portion is fitted to the opposing connector.

15. The electrical connector according to claim 12, wherein the lock member is pivotably attached to the connector portion.

16. The electrical connector according to claim 12, wherein the connector portion is configured to be fitted to the opposing connector along a first direction, and wherein the electrical connector further comprises an electric cable assembly connected to the connector portion and extending in a second direction perpendicular to the first direction.

17. The electrical connector according to claim 16, wherein the lock member is located at a rear end of the connector portion that is connected to the electric cable assembly.

18. The electrical connector according to claim 12, wherein the connector portion is configured to be fitted to the opposing connector along a fitting direction that is perpendicular to both the downward direction and the inward direction.

19. The electrical connector according to claim 12, wherein the lock member further includes at least one release operation portion configured to disengage the engagement portion from the opposing connector, and wherein a main surface of the release operation portion is substantially flush with a main surface of the main body portion.

20. The electrical connector according to claim 12, wherein the engagement portion is located at a rear end of the connector portion that is connected to an electric cable assembly.

* * * * *